US006657126B2

(12) United States Patent
Ide et al.

(10) Patent No.: US 6,657,126 B2
(45) Date of Patent: Dec. 2, 2003

(54) WIRE BRANCH PROCESSING FOR SHIELDED WIRE

(75) Inventors: Tetsuro Ide, Shizuoka (JP); Akira Mita, Shizuoka (JP); Nobuyuki Asakura, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/128,580

(22) Filed: Apr. 24, 2002

(65) Prior Publication Data

US 2002/0163415 A1 Nov. 7, 2002

(30) Foreign Application Priority Data

Apr. 25, 2001 (JP) ..... P.2001-127998
Apr. 25, 2001 (JP) ..... P.2001-128223
Apr. 25, 2001 (JP) ..... P.2001-128253
Apr. 25, 2001 (JP) ..... P.2001-128260

(51) Int. Cl.[7] ..... H01R 4/00
(52) U.S. Cl. ..... 174/78; 174/84 R
(58) Field of Search ..... 174/78, 84 R, 174/94 R, 75 R, 75 C, 36; 439/98, 99

(56) References Cited

U.S. PATENT DOCUMENTS 3,843,568 A * 10/1974 Woodland et al. ..... 521/54
5,210,377 A * 5/1993 Kennedy et al. ..... 174/107
5,477,011 A * 12/1995 Singles et al. ..... 174/102 R
5,666,452 A * 9/1997 Deitz et al. ..... 385/100
6,087,589 A * 7/2000 Ide ..... 174/78
6,201,188 B1 * 3/2001 Ide ..... 174/84 R
6,226,865 B1 * 5/2001 Tanikawa et al. ..... 29/872
6,476,324 B1 * 11/2002 Ide et al. ..... 174/84 R

FOREIGN PATENT DOCUMENTS

EP 0373120 A1 * 6/1990 ..... H01B/11/18
JP 11-135167 5/1999

* cited by examiner

*Primary Examiner*—Chau N. Nguyen
(74) *Attorney, Agent, or Firm*—Sughrue Mion, PLLC

(57) ABSTRACT

In at least one shielded core wire, a first conductive core wire is covered with a first insulating sheath. A conductive foil covers the at least one shielded core wire. A second insulating sheath covers the conductive foil. In a branch wire, a second conductive core wire is covered with a third insulating sheath. A part of the second insulating sheath and a part of the third insulating sheath are thermally fused so that the conductive foil and the second conductive core wire are electrically connected.

23 Claims, 18 Drawing Sheets

WIRE BRANCH PROCESSING FOR SHIELDED WIRE

BACKGROUND OF THE INVENTION

The present invention relates to a structure and a method for branching a conductive wire from a shielded wire which including a core conductive wire and an insulating sheath.

A related-art example of this kind has been disclosed in Japanese Patent Publication No. 4-269470A shown in FIGS. 17 and 18.

In a branching structure shown in FIG. 17, an insulating outer sheath 101 provided in the vicinity of the end of a shielded wire 100 is partially peeled and a braided wire 102 to be a shielding cover is exposed. An insulating outer sheath 104 provided on the end of a grounding wire 103 is peeled to expose a conductive wire 105. The braided wire 102 of the shielded wire 100 and the conductive wire 105 of the grounding wire 103 are pressed and fixed through a coupling member 106.

In a branching structure shown in FIG. 18, an insulating outer sheath 111 provided on the end of a shielded wire 110 is peeled to expose a drain wire 112, and the drain wire 112 thus exposed is used as a grounding wire.

However, both of the branching structures have a problem in that the number of steps is great and a large number of manual works are to be carried out. For this reason, automation cannot be achieved;

A related branching structure to solve such a problem has been disclosed in Japanese Patent Publication No. 11-135167A shown in FIGS. 19 and 20.

In the branching structure shown in FIGS. 19 and 20, a braided wire 120*d* of a shielded wire 120 is electrically connected to a conductive wire 123*a* of a grounding wire 123 by an ultrasonic horn 125 through a pair of resin members 121 and 122.

In other words, the shielded wire 120 is constituted by one shielding core 120*c* having a core 120*a* covered with an insulating inner sheath 120*b,* a conductive braided wire 120*d* for covering the outer periphery of the shielding core 120*c,* and an insulating outer sheath 120*e* for further covering the outer periphery of the braided wire 120*d.* A pair of resin members 121 and 122 have concave portions 121*b* and 122*b* for forming a hole corresponding to the outer sectional shape of the shielded wire 120 with mutual bonding faces 121*a* and 122*a* buffed against each other, respectively. The grounding wire 123 is constituted by the conductive wire 123*a* and an insulating outer sheath 123*b* for covering an outer periphery thereof. The ultrasonic horn 125 is constituted by a lower support base (not shown) provided in a lower part and an ultrasonic horn body 125*a* provided in an upper part.

Next, a blanching procedure will be described. The lower resin member 122 is provided on the lower support base (not shown) of the ultrasonic horn 125, the shielded wire 120 is mounted from thereabove, one end of the grounding wire 123 is mounted thereon, and furthermore, the upper resin member 121 is put from thereabove. Thus, the shielded wire 120 is provided In the concave portions 121*b* and 122*b* of the resin members 121 and 122, and the grounding wire 123 is provided between the shielded wire 120 and the upper resin member 121.

In this state, a vibration is applied by the ultrasonic horn 125 while applying compression force between the resin members 121 and 122. Consequently, the insulating outer sheath 120*e* of the shielded wire 120 and the Insulating outer sheath 123*b* of the grounding wire 123 are fused and scattered by the internal heat generation of a vibration energy so that the conductive wire 123*a* of the grounding wire 123 and the braided wire 120*d* of the shielded wire 120 come in electrical contact with each other. Moreover, each of the contact portions of the bonding faces 121*a* and 122*a* of the resin members 121 and 122, the contact portion of the internal peripheral faces of the concave portions 121*b* and 122*b* of the resin members 121 and 122, the insulating outer sheath 120*e* of the shielded wire 120, the contact portion of the insulating resin 123*b* of the grounding wire 123, and the resin members 121 and 122 are fused by the heat generation of the vibration energy and the fused portions are solidified after the ultrasonic vibration is completely applied. Consequently, the resin members 121 and 122, the shielded wire 120 and the grounding wire 123 are fixed to each other.

According to the branch processing, it is not necessary to peel the insulating outer sheaths 120*e* and 123*b* of the shielded wire 120 and the grounding wire 123, and the lower resin member 122, the shielded wire 120, the grounding wire 123 and the upper resin member 121 are simply assembled in this order to give the ultrasonic vibration. Consequently, the number of steps is decreased, and a complicated manual work is not required and automation can also be achieved.

Accordingly, the grounding wire 123 of the shielded wire 120 is thus caused to branch so that a noise flowing through the core wire 120*c* can be caused to escape from the braided wire 120*d* toward the ground through the conductive wire 123*a* of the grounding wire 123.

In such a wire branch processing, however, the shielding cover of the shielded wire 120 is the braided wire 120*d.* Therefore, the contact of the braided wire 120*d* with the conductive wire 123*a* has a relationship in which the surfaces of sectional circular lines come in contact with each other and their contact area is decreased so that their connecting reliability is deteriorated as shown in FIG. 19.

Moreover, the contact area of the braided wire 120*d* and the conductive wire 123*a* is decreased so that the amount of escaped noise is reduced. Consequently, a drain wire (not shown) is provided in the shielded wire 120 to maintain the amount of escape of the noise. In this case, it is necessary to additionally provide the drain wire. Therefore, the number of members is increased with a complexity of the structure so that the cost of the shielded wire 120 is increased, and furthermore, a weight becomes greater.

In the branching structure, the single core type shielded wire 120 can be properly shielded. However, if the same structure is applied to a multicore type shielded wire having a different internal configuration, the following drawbacks would be occurred.

More specifically, a multicore shielded wire has such a structure that a plurality of shielded core wires are accommodated with a clearance in the internal space of an insulating outer sheath and a braided wire. For this reason, the degree of a close contact and the arrangement relationship between the braided wire and the shielded core wires are indefinite with an interposition between the resin members 121 and 122. In some cases in which the degree of a close contact is excessive, the insulating inner sheath of the shielded core wire is broken or cut upon receipt of the transmission of great vibration energy. Consequently, the grounding wire or the shielding cover comes in contact with the core to cause a short circuit, and furthermore, the strength of the multicore shielded wire is reduced.

In order to eliminate such a drawback, it can be proposed that the vibration energy to be applied by the ultrasonic vibration is reduced. However, in such a condition, a bonding strength based on the fusion and solidification between the resin members 121 and 122 is accordingly reduced.

SUMMARY OF THE INVENTION

It is therefore a first object of the present invention to provide a structure and a method for branching a shielded wire in which the connecting reliability of a branch wire branched from the shielded wire can be enhanced and the structure can be simplified to decrease the number of members.

It is a second object of the invention to provide a structure and a method for branching a multicore shielded wire in which a pair of resin members can be connected firmly, and furthermore, a short circuit can be prevented from being caused by the contact of a grounding wire or a shielding cover with a core wire so that the strength of the multicore shielded wire can be prevented from being reduced.

In order to achieve the above objects, according to the present invention, there Is provided A shielded wire, comprising;

at least one shielded core wire, in which a first conductive core wire is covered with a first insulating sheath;

a conductive foil, which covers the at least one shielded core wire;

a second Insulating sheath, which covers the conductive foil; and a branch wire, in which a second conductive core wire is covered with a third insulating sheath;

wherein a part of the second insulating sheath and a part of the third insulating sheath are thermally fused so that the conductive foil and the second conductive core wire are electrically connected.

In this configuration, when the second conductive wire of the branch wire is connected in contact with the conductive foil, their contact area can be increased so that the connecting reliability of the branch wire to branch from the shielded wire can be enhanced.

In the case in which the branch wire is used as an earth wire, a noise passing through the core wire can be caused to efficiently escape through the branch wire so that an extra drain wire can be eliminated from the shielded wire. Consequently, the number of members constituting the shielded wire can be decreased and the structure can be simplified so that an inexpensive shielded wire can be provided, and furthermore, the weight of the shielded wire can be reduced.

Preferably, the shielded wire further comprises a reinforcing member provided on an inner face of the conductive foil.

In this configuration, since the conductive foil can be reinforced by the reinforcing foil member, even when the shielded wire is subjected to press contact operation, the deformation of the conductive foil can be suppressed. Therefore, the contact area of the conductive foil and the second conductive wire can be maintained more reliably.

Here, it is preferable that the reinforcing member is a polyester sheet.

In this configuration, the conductive foil can be reinforced strongly while maintaining the appropriate flexibility of the shielded wire.

Preferably, a space between the conductive foil and the at least one shielded core wire is filled with an insulating material having a heat-resistant property.

In this configuration, particularly in a case where a multicore shielded wire is adopted, a plurality of shielded core wires are seldom moved by the Insulating material filled in the conductive cover foil. Therefore, it can be prevented the displacement of the shielded core wires due to a press contact operation or an ultrasonic vibration in ultrasonic welding or the like. Moreover, the position of the conductive foil is also stabilized by the insulating material.

In addition, since the outer periphery of the shielded core wire is covered with the heat-resistant insulating material, the first insulating sheath of the shielded core wire is neither broken nor cut by heat generation caused by the ultrasonic vibration.

Alternatively, the shielded wire further comprises a drain wire provided inside of the conductive foil.

In this configuration, since the shielding can also be carried out by earthing the drain wire, there is an advantage that a variation in a countermeasure against the shielding can be increased correspondingly.

In order to attain the same advantages, according to the present invention, there is also provided a shielded wire, comprising:

at least one shielded core wire, in which a first conductive core wire is covered with a first insulating sheath;

a conductive cover member, which covers the at least one shielded core wire;

a second insulating sheath, which covers the conductive foil; and a branch wire, in which a second conductive core wire is covered with a third insulating sheath, wherein a part of the second insulating sheath and a part of the third insulating sheath are thermally fused so that the conductive foil and the second conductive core wire are electrically connected; and wherein a space between the conductive foil and the at least one shielded core wire is filled with an insulating material having a heat-resistant property.

Preferably, the conductive cover member is a metal foil.

Here, it is preferable that the shielded wire further comprises a reinforcing member provided on an inner face of the conductive foil.

Here, it is preferable that the reinforcing member is a polyester sheet.

Preferably, the shielded wire further comprises a drain wire provided inside of the conductive foil.

In order to achieve the above objects, according to the present invention, there is also provided a method of branching a sheathed wire from a shielded wire, comprising the steps of:

providing at least one shielded core wire, in which a first conductive core wire is covered with a first insulating sheath;

covering the at least one shielded core wire with a conductive cover member;

covering the conductive cover member with a second insulating sheath to constitute the shielded wire;

providing the sheathed wire in which a second conductive core wire is covered with a third insulating sheath;

providing a pair of resin members, in which a bonding face including a groove is formed in each resin member and at least one protrusion is formed on at least one of the bonding faces;

sandwiching the shielded wire and the sheathed wire between the pair of resin members such that the grooves face with each other while accommodating the sheathed wire therein;

applying ultrasonic vibration such that ultrasonic waves are concentrated to the protrusions to thermally fuse at least the protrusion so that the bonding faces of the resin members are integrated with each other, while thermally fusing a part of the second insulating sheath and a part of the third insulating sheath so that the conductive cover member and the second conductive core wire are electrically connected.

In this configuration, when the ultrasonic vibration is started to be applied in this state, the vibration energy concentrates on the protrusion so that the resin members are sufficiently fused and firmly come in close contact with each other in the vicinity of the mutual bonding faces. By such concentration of the vibration energy in the protrusions, the vibration energy to be applied to the grounding wire or the shielded core wire can be reduced. Consequently, the first insulating sheath can be prevented from being broken or cut due to the fusion caused by the transmission of an excessive vibration energy. Accordingly, the resin members can be connected firmly, and furthermore, a short circuit can be prevented from being caused by the contact of the branch wire or the conductive cover member with the first conductive core wire, and therefore the strength of the multicore shielded wire can be maintained.

Preferably, the protrusion includes a pair of protrusions formed at both sides of at least one of the groove so as to extend therealong.

In this configuration, the vibration energy concentrates on the protrusion in any position in the axial direction of the shielded wire. Consequently, it is possible to uniformly reduce the vibration energy to be applied to the shielded core wire in the axial direction of the shielded wire.

Preferably, the protrusion includes two pairs of protrusions formed at both sides of the grooves so as to be abutted on each other in the sandwiching step.

In this configuration, a pair of resin members can have the same shape. Consequently, there is an advantage that the manufacturing cost of the resin member can be reduced and the resin members can be handled easily.

Preferably, the second conductive core wire is a plated wire having a melting temperature which is lower than a temperature of an internal heat generated by the ultrasonic vibration.

In this configuration, the plated wire is partially fused to come in contact with the conductive cover member by the vibration energy. Consequently, it is possible to enhance a reliability in the contact portion of the conductive cover member of the shielded wire and the second conductive core wire of the sheathed wire.

Preferably, the branching method further comprising the steps of providing an ultrasonic horn for applying the ultrasonic vibration, and contacting a contact face of the ultrasonic horn with a contact face of one resin member. Here, at least one of the contact face of the ultrasonic horn and the contact face of the resin member is formed with a recessed portion.

In this configuration, the vibration generated from the ultrasonic horn body is transmitted to the shielded wire through the resin member provided in contact therewith. The ultrasonic horn body and the resin member are provided in contact with each other in a small area by the recessed portion. Therefore, the vibration to be applied to the conductive cover member is reduced through the resin member so that the shield covering member is neither broken nor cut due to the ultrasonic vibration and heat generation. Accordingly, the electrical contact of the sheathed wire and the shielded wire can be obtained reliably so that an electric performance can be enhanced, and furthermore, the strength of the shielded wire can be maintained.

Here, it is preferable that the recessed portion is situated at a position opposing to a position at which the conductive cover member and the second conductive core wire are electrically connected.

In this configuration, the vibration to be transmitted at the shortest distance from the ultrasonic horn body to the electrical contact portion of the shielded wire and the sheathed wire though the resin member does not act. Consequently, it is possible to effectively reduce the vibration to be applied to the electrical contact portion.

In order to attain the same advantages, according to the present Invention, there is also provided a method of branching a sheathed wire from a shielded wire, comprising the steps of:

providing at least one shielded core wire, in which a first conductive core wire is covered with a first insulating sheath;

covering the at least one shielded core wire with a conductive cover member;

covering the conductive cover member with a second insulating sheath to constitute the shielded wire;

providing the sheathed wire in which a second conductive core wire is covered with a third insulating sheath;

providing a pair of resin members, in which a bonding face including a groove is formed in each resin member, and in which a contact face is formed on one of the resin members;

sandwiching the shielded wire and the sheathed wire between the pair of resin members such that the grooves face with each other while accommodating the sheathed wire therein;

providing an ultrasonic horn having a contact face;

contacting the contact face of the ultrasonic horn with the contact face of the resin member; and applying ultrasonic vibration to thermally fuse and integrate the bonding faces of the resin members with each other, while thermally fusing a part of the second insulating sheath and a part of the third insulating sheath so that the conductive cover member and the second conductive core wire are electrically connected, wherein at least one of the contact face of the ultrasonic horn and the contact face of the resin member is formed with a recessed portion.

Preferably, the recessed portion is situated at a position opposing to a position at which the conductive cover member and the second conductive core wire are electrically connected.

Preferably, at least one protrusion is formed on at least one of the bonding faces. The ultrasonic vibration is applied such that ultrasonic waves are concentrated to the protrusions to thermally fuse at least the protrusion while integrating the bonding faces of the resin members with each other Here, it is preferable that the protrusion includes a pair of protrusions formed at both sides of at least one of the groove so as to extend therealong.

Here, it is preferable that the protrusion includes two pairs of protrusions formed at both sides of the grooves so as to be abutted on each other in the sandwiching step.

Preferably, the second conductive core wire is a plated wire having a melting temperature which is lower than a temperature of an internal heat generated by the ultrasonic vibration.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

Preferred embodiments of the invention will be described below with reference to the accompanying drawings.

Figure 6:
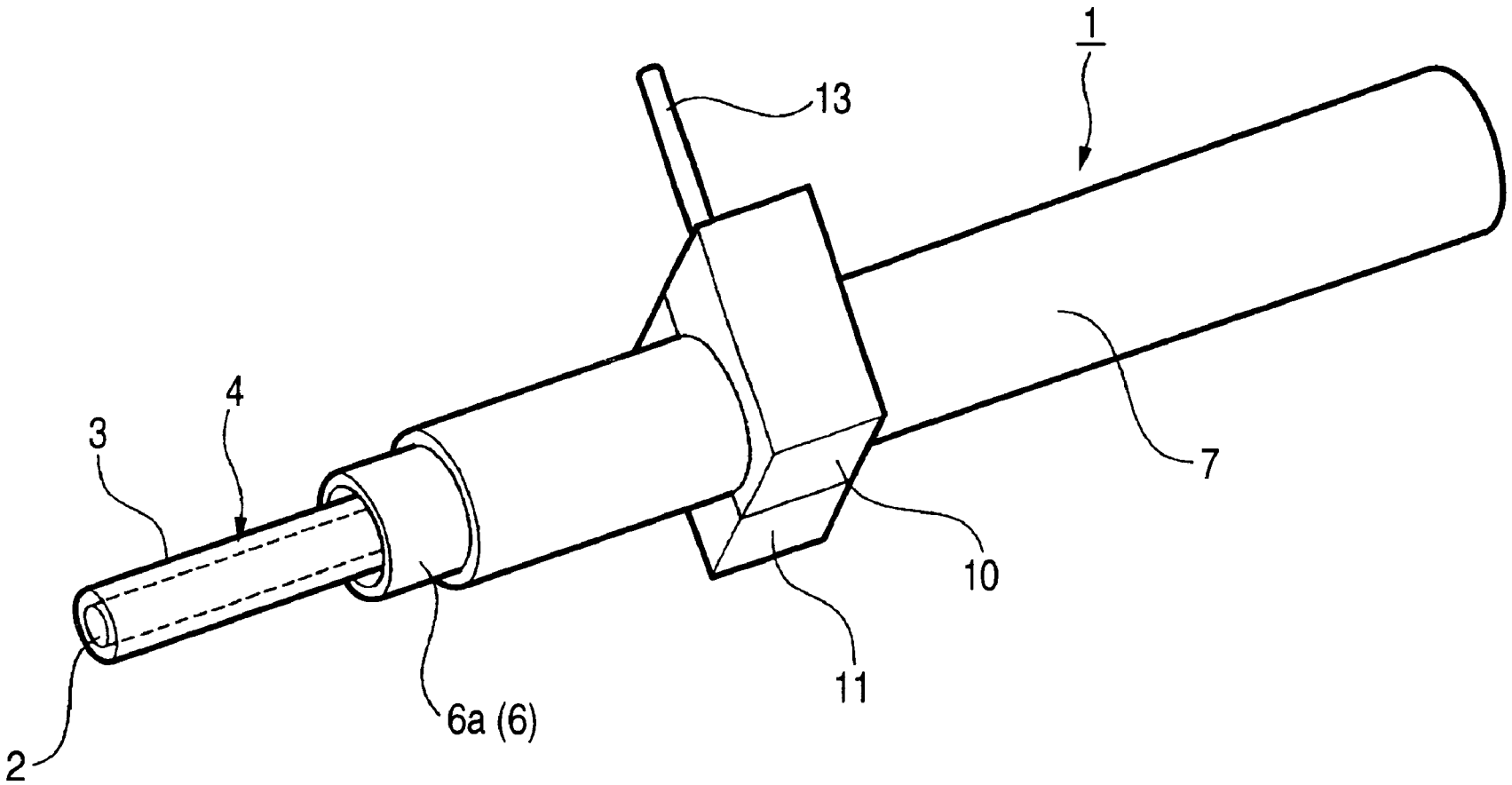
FIG. 6 is a perspective view showing the wire branching structure according to the first embodiment.

A wire branching structure of a shielded wire according to a first embodiment will be described by taking, as an example, the case in which a grounding wire 13 for grounding a shielded wire 1 is used as a branch wire as shown in FIG. 6.

More specifically, in the wire branching structure according to the embodiment, a shielding cover 6 of the shielded wire 1 is electrically connected to a conductive wire 13*a* of a grounding wire 13 by an ultrasonic horn 15 by utilizing a pair of resin members 10 and 11 and detailed description will be given below.

Figure 1:
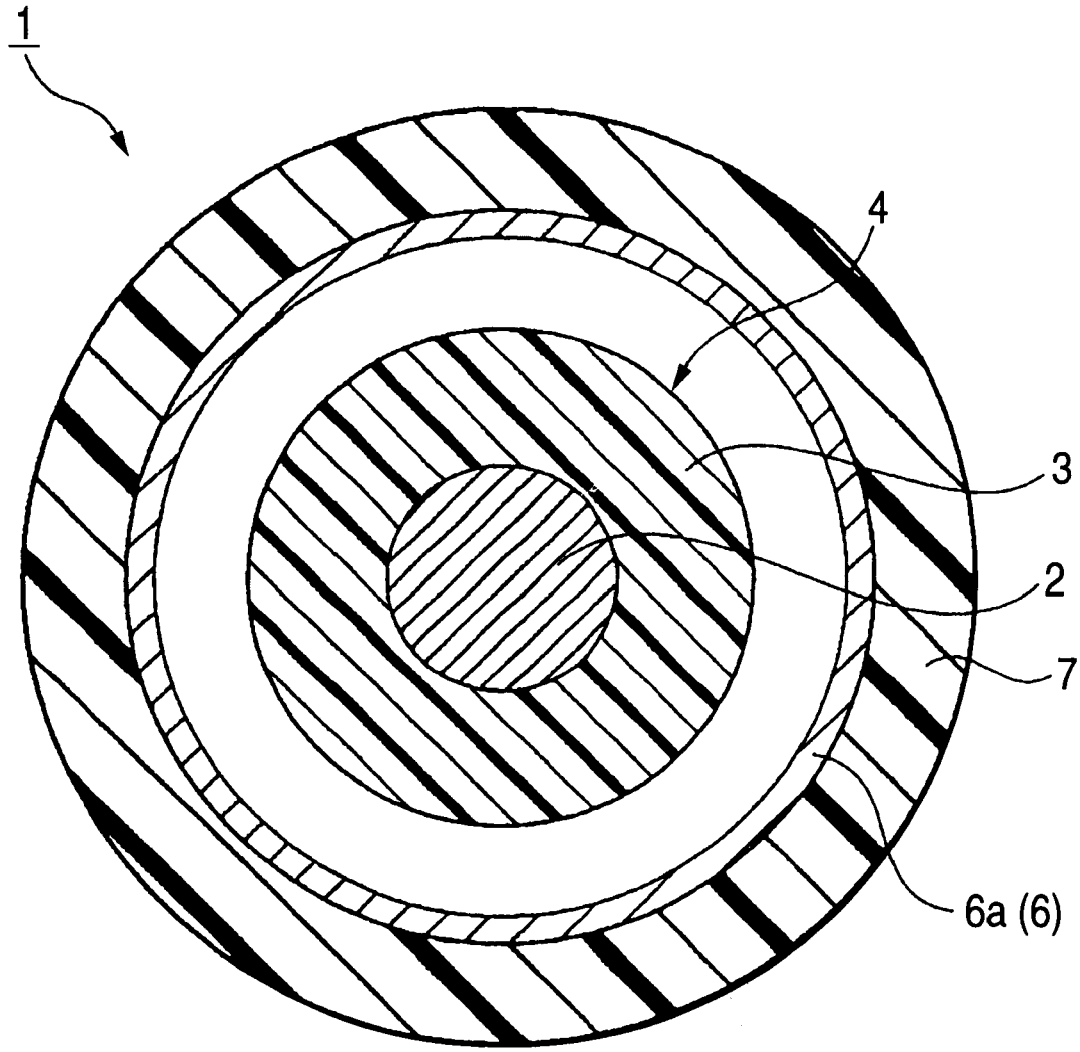
FIG. 1 is a sectional view showing a shielded wire according to a first embodiment of the invention.

As shown in FIG. 1, the shielded wire 1 is constituted by a core wire 4 having a conductive core 2 covered with an insulating inner sheath 3, a conductive shielding cover 6 for covering the outer periphery of the core wire 4, and an insulating outer sheath 7 for further covering the outer periphery of the shielding cover 6.

Figure 3:
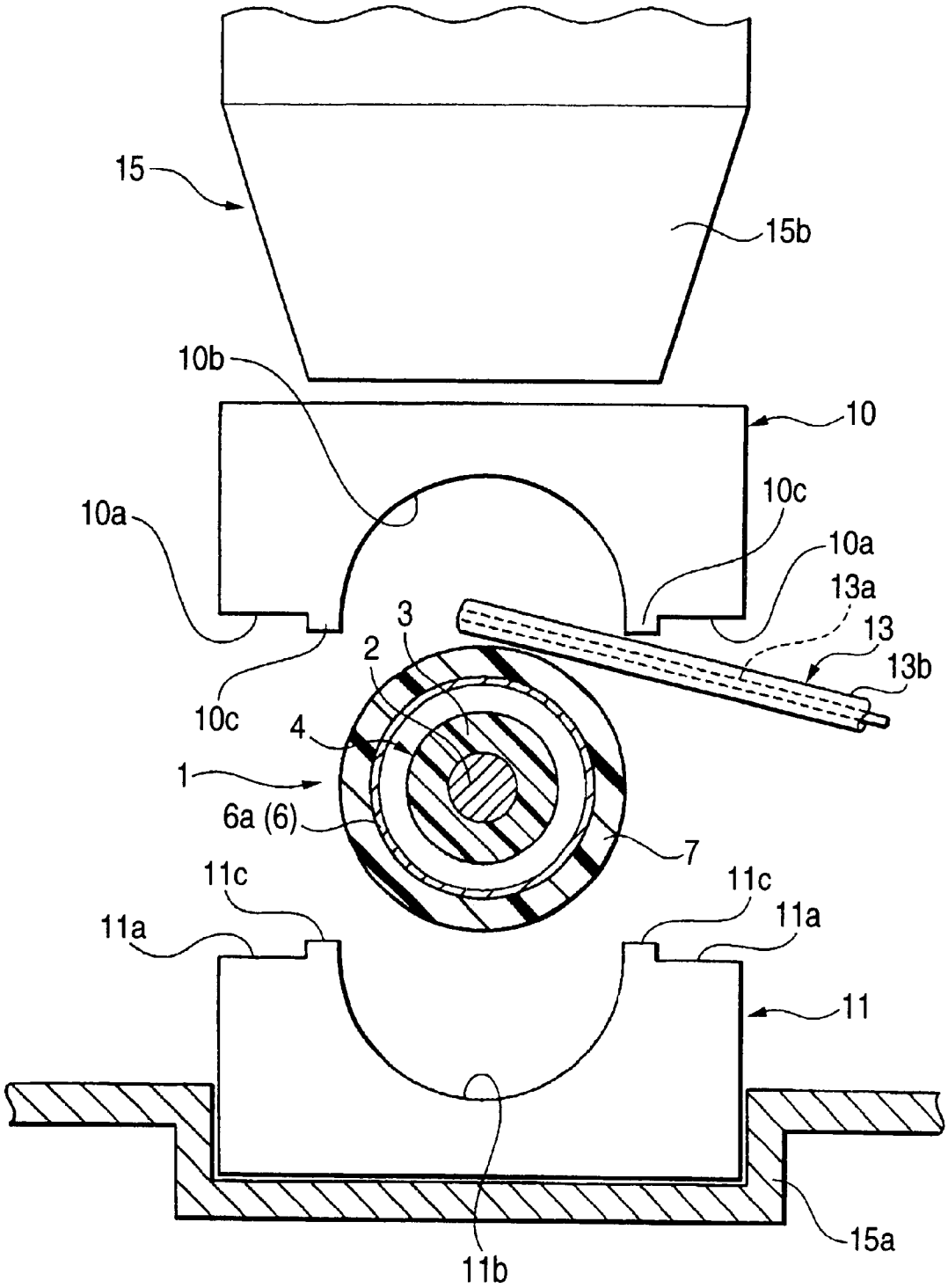
FIG. 3 is a sectional view showing the relationship of arrangement of each member for the application of an ultrasonic vibration for carrying out a wire branch processing according to the first embodiment.

On the other hand, the grounding wire 13 to be the branch wire connected to the shielded wire 1 is constituted by covering the conductive wire 13*a* with the insulating outer sheath 13*b* as shown in FIG. 3.

Figure 5:
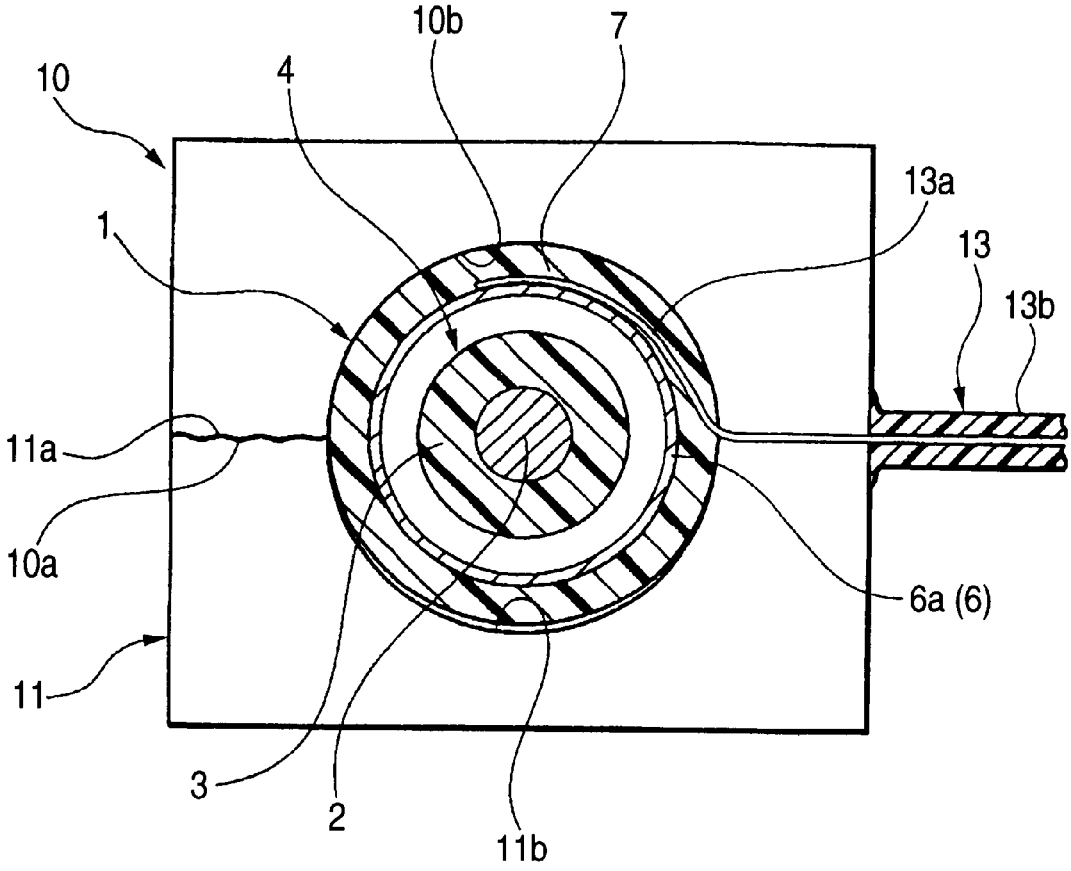
FIG. 5 is a sectional view showing a wire branching structure according to the first embodiment of the invention.

As shown in FIG. 5, the conductive wire 13*a* of the grounding wire 13 is connected to the shielding cover 6 through the resin members 10 and 11 at the terminal of the shielded wire 1 so that the grounding wire 13 branches as an earth wire from the shielded wire 1.

In the embodiment, an aluminum foil 6*a* is used for the shielding cover 6. In the following, detailed description will be given to the wire branching structure of the shielded wire 1 using the aluminum foil 6*a* for the shielding cover 6.

Figure 2:
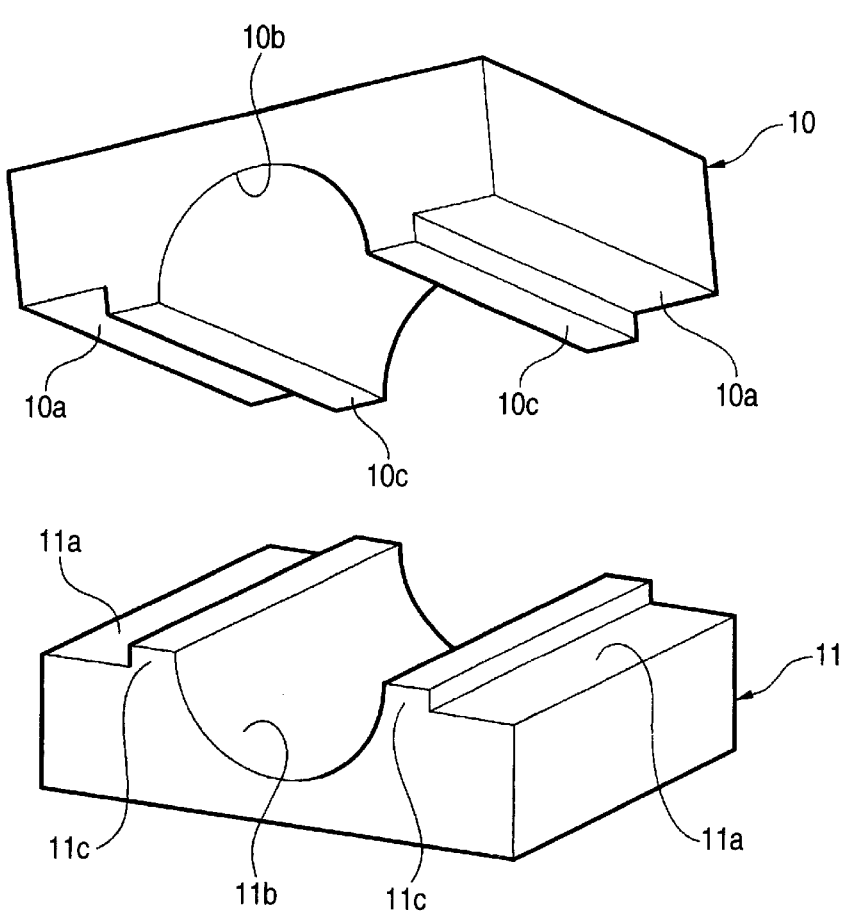
FIG. 2 is a perspective view showing a pair of resin members used in the first embodiment.

As shown in FIG. 2, the resin members 10 and 11 are blocks having the same shape and formed of a synthetic resin, and concave portions 10*b* and 11*b* for forming a hole almost corresponding to the outer sectional shape of the shielded wire 1 are formed with mutual bonding faces 10*a* and 11*a* abutted against each other, respectively. The concave portions 10*b* and 11*b* are semicircular arc-shaped grooves having the radius of the outer shape of the shielded wire 1 set to be a radius in detail. Moreover, the resin members 10 and 11 are continuously provided with protrusions 10*c* and 11*c* on the left and right of the concave portions 10*b* and 11*b* along peripheral edges thereof. The protrusions 10*c* and 11*c* of the resin members 10 and 11 are provided in positions in which the bonding faces 10*a* and 11*a* are opposed to each other.

As the physical properties of the resin members 10 and 11, moreover, they are less fused than the insulating outer sheath 7 and are formed of an acryl based resin, an ABS (acrylonitrile-butadiene-styrene copolymer) based resin, a PC (polycarbonate) based resin, a PE (polyethylene) based resin, a PEI (polyetherimide) based resin or a PBT (polybutylene terephthalate) based resin, and are generally harder than vinyl chloride to be used for the insulating outer sheath 7.

In respect of conductivity and conductive safety, practicality is required for all the resins described above and the PEI (polyetherimide) based resin and the PBT (polybutylene terephthalate) based resin are particularly suitable if a decision is carried out including appearance and insulating properties.

As shown in FIG. 3, the ultrasonic horn 15 is constituted by a lower support base 15*a* capable of positioning the resin member 11 provided in the lower part, and an ultrasonic horn body 15*b* provided just above the lower support base 15*a* and capable of applying an ultrasonic vibration while causing pressing force to act downward.

Next, a branching procedure will be described. As shown in FIG. 3, the lower resin member 11 is provided on the lower support base 15*a* of the ultrasonic horn 15, the vicinity of the end of the shielded wire 1 is mounted from above the resin member 11, one end of the grounding wire 13 is mounted thereon, and furthermore, the upper resin member 10 is put from thereabove. Thus, the shielded wire 1 is provided in the concave portions 10*b* and 11*b* of the resin members 10 and 11 and the grounding wire 13 is provided between the shielded wire 1 and the upper resin member 10.

Figure 4:
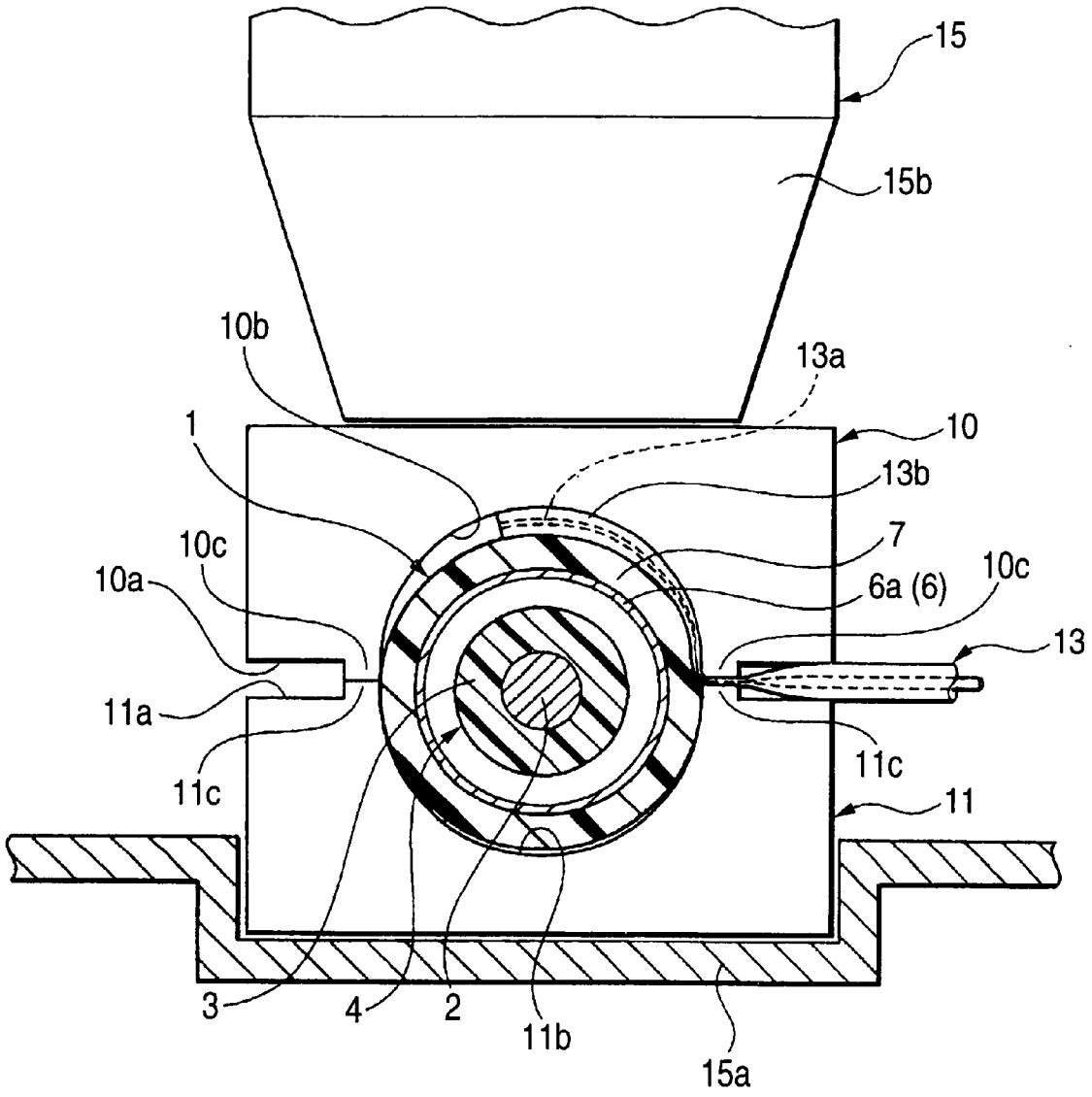
FIG. 4 is a sectional view showing the set state of each member which is obtained immediately before the application of the ultrasonic vibration for carrying out the wire branch processing according to the first embodiment.

As shown in FIG. 4, next, the ultrasonic horn body 15*b* is brought down to give a vibration through the ultrasonic horn 15 while applying the compression force between the resin members 10 and 11. Consequently, the insulating outer sheath 7 of the shielded wire 1 and the insulating outer sheath 13*b* of the grounding wire 13 are fused and scattered by the internal heat generation of a vibration energy so that the conductive wire 13*a* of the grounding wire 13 and the aluminum foil 6*a* of the shielded wire 1 come in electric contact with each other (see FIG. 5).

Moreover, each of the contact portions of the bonding faces 10*a* and 11*a* of the resin members 10 and 11, the contact portion of the internal peripheral faces of the concave portions 10*b* and 11*b* of the resin members 10 and 11 and the insulating outer sheath 7 of the shielded wire 1, and the contact portion of the insulating resin 13*b* of the grounding wire 13 and the resin members 10 and 11 are fused by the internal heat generation of the vibration energy and the fused portions are solidified after the ultrasonic vibration is completely applied. Consequently, the resin members 10 and 11 the shielded wire 1 and the grounding wire 13 are fixed to each other (see FIGS. 5 and 6).

In the embodiment, thus, the ultrasonic fusion is carried out by using the ultrasonic horn 15, thereby causing the grounding wire 13 to branch. Consequently, it is not necessary to peel the insulating outer sheaths 7 and 13*b* of the shielded wire 1 and the grounding wire 13 and it is preferable that the lower resin member 11, the shielded wire 1, the grounding wire 13 and the upper resin member 10 should be assembled in this order to give the ultrasonic vibration. Therefore, the number of steps is decreased, and a complicated manual work is not required and automation can also be achieved.

In the operation process, moreover, the resin members 10 and 11 come in close contact with each other through the protrusions 10*c* and 11*c* before the ultrasonic vibration is given. When the ultrasonic vibration is started to be given in this state, the vibration energy concentrates on the protrusions 10*c* and 11*c*. Consequently, the resin members 10 and 11 are sufficiently fused in the vicinity of the mutual bonding faces 10*a* and 11*a* and firmly come in close contact with each other.

As described above, in the wire branching structure of the shielded wire according to the embodiment, the shielding cover 6 is formed of the aluminum foil 6*a*. Consequently, when the conductive wire 13*a* of the grounding wire 13 is connected in contact with the aluminum foil 6*a*, the contact area of the aluminum foil 6*a* and the conductive wire 13*a* can be increased.

Accordingly, the connecting reliability of the grounding wire 13 to branch from the shielded wire 1 can be thus enhanced by an increase in the contact area, and the grounding wire 13 to be used as an earth wire can cause a noise passing through the core wire 4 of the shielded wire 1 to efficiently escape toward the ground.

Moreover, the noise of the shielded wire 1 can be thus caused to efficiently escape toward the ground by the grounding wire 13. Therefore, an extra drain wire is not required for the shielded wire 1. More specifically, the drain wire has conventionally been provided in parallel with the core wire 4 in the shielding cover 6 in order to completely remove the noise in some cases. In the embodiment, the contact area of the aluminum foil 6*a* and the conductive wire 13*a* can be greatly increased so that the noise can be eliminated reliably. Consequently, the drain wire can be disused.

Figure 7:
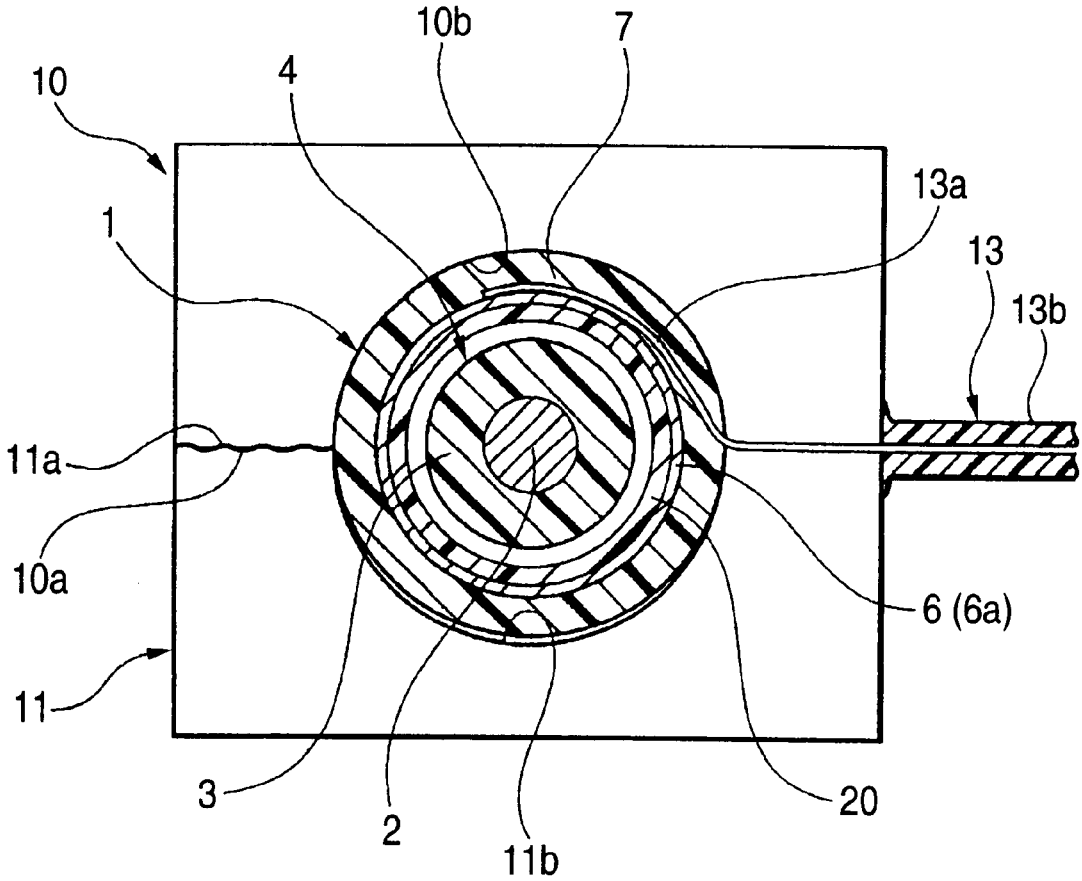
FIG. 7 is a sectional view showing a wire branching structure according to a second embodiment of the invention.

FIG. 7 a sectional view showing a second embodiment of the invention which corresponds to FIG. 5. The same components as those in the first embodiment have the same reference numerals and repetitive description will be omitted.

This embodiment is mainly different from the first embodiment in that a reinforcing foil member is attached to the inside of the aluminum foil 6*a* as shown in FIG. 7. In the embodiment, a polyester sheet 20 is used for the reinforcing foil member and is attached to the whole periphery on the inside of the aluminum foil 6*a*.

In the embodiment accordingly, the aluminum foil 6*a* can be reinforced by the polyester sheet 20 attached to the inside thereof. Also when the conductive wire 13*a* of the grounding wire 13 is pressed in contact, therefore, the deformation of the aluminum foil 6*a* can be suppressed and the contact area of the aluminum foil 6*a* and the conductive wire 13*a* can be maintained more reliably.

Moreover, the polyester sheet 20 is used for the reinforcing foil member so that the aluminum foil 6*a* can be firmly reinforced with the appropriate flexibility of the shielded wire 1 maintained. Accordingly, it is possible to easily obtain the wiring layout of the shielded wire 1 while enhancing the connecting reliability of the shielded wire, and the grounding wire 13.

Figure 8:
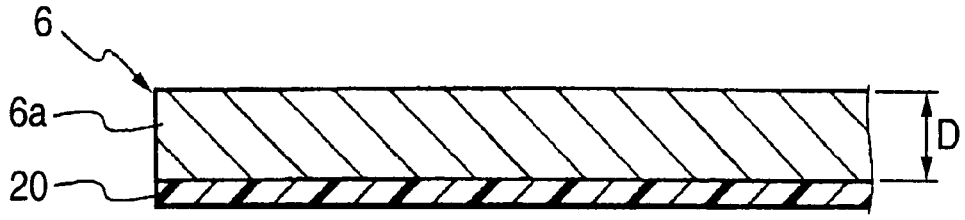
FIG. 8 is an enlarged sectional view showing an expanded metal foil covering member in a shielded wire shown in FIG. 7.

In the embodiment, the aluminum foil 6*a* is preferably provided to have the thickness D of 50 micrometers or more (see FIG. 8). Therefore, even if a slightly great vibration and heat generation act on the shielding cover 6, the shielding cover 6 is neither broken nor cut. In the embodiment, accordingly, the electrical contact of the grounding conductor 13 and the shielding cover 6 can be reliably obtained with a reduction in the ultrasonic vibration. Consequently, the electric performance can further be enhanced, and furthermore, it is possible to reliably prevent such a situation that the strength of the electric wire is reduced.

In the above embodiments, while the case in which the shielded wire 1 is a single core wire 4 has been described, it is a matter of course that the invention can also be applied even if the core wire 4 having two wires or more is used.

Figure 9:
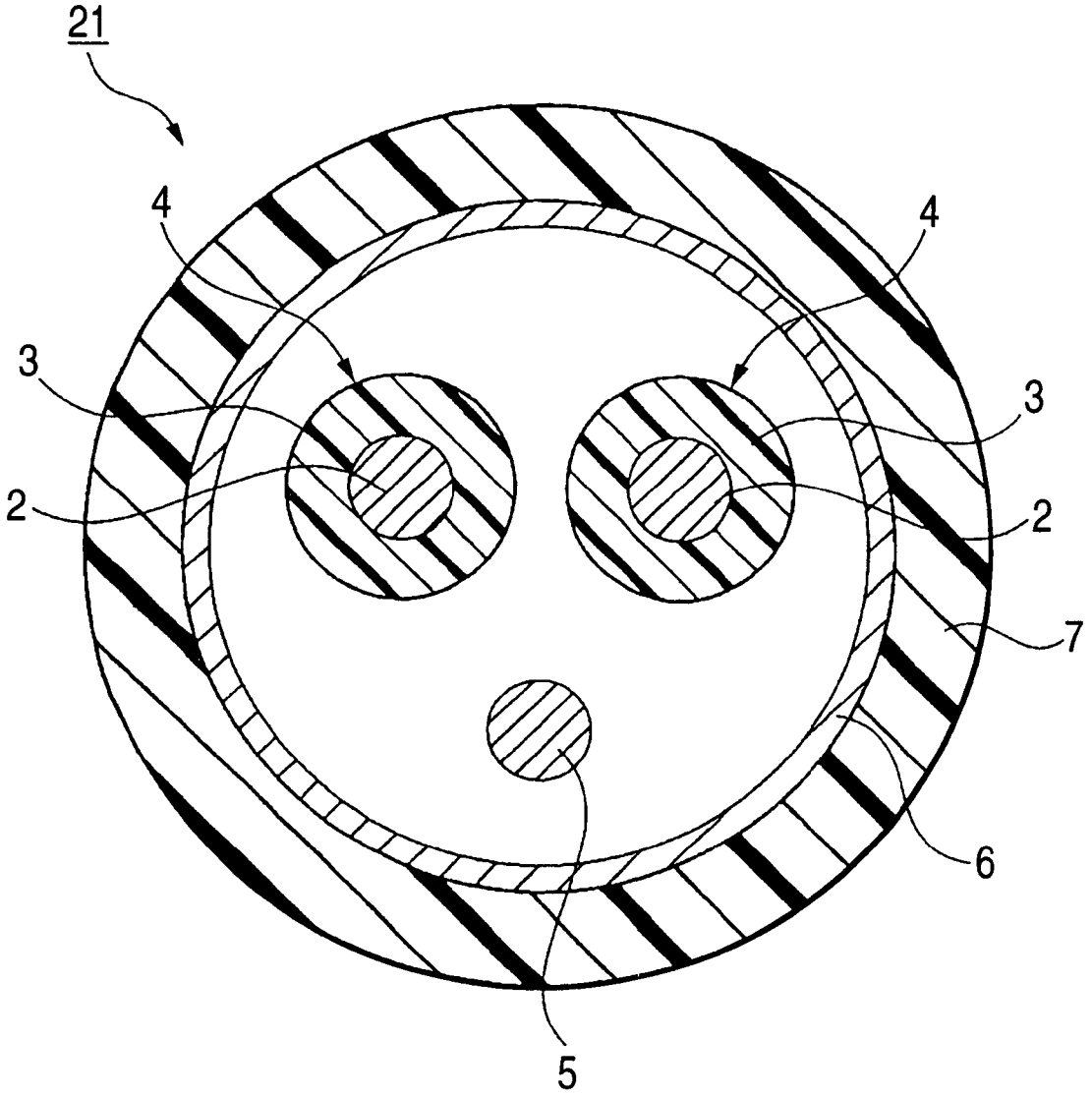
FIG. 9 is a sectional view showing a shielded wire according to a third embodiment of the invention.

FIG. 9 shows a multicore shielded wire according to a third embodiment of the invention. The multicore shielded wire 21 is constituted by two shielded core wires 4 each having a core wire 2 covered with an insulating inner sheath 3, a drain wire 6, an aluminum foil to be a shielding cover 6 for covering the outer periphery of the two shielded core wires 4 and the drain wire 5, and an insulating outer sheath 7 for further covering the outer periphery of the shielding cover 6. The Insulating inner sheath 3 and the insulating outer sheath 7 are formed of a synthetic resin, and the core wire 2 and the drain wire 5 are formed of a conductive material.

Figure 10:
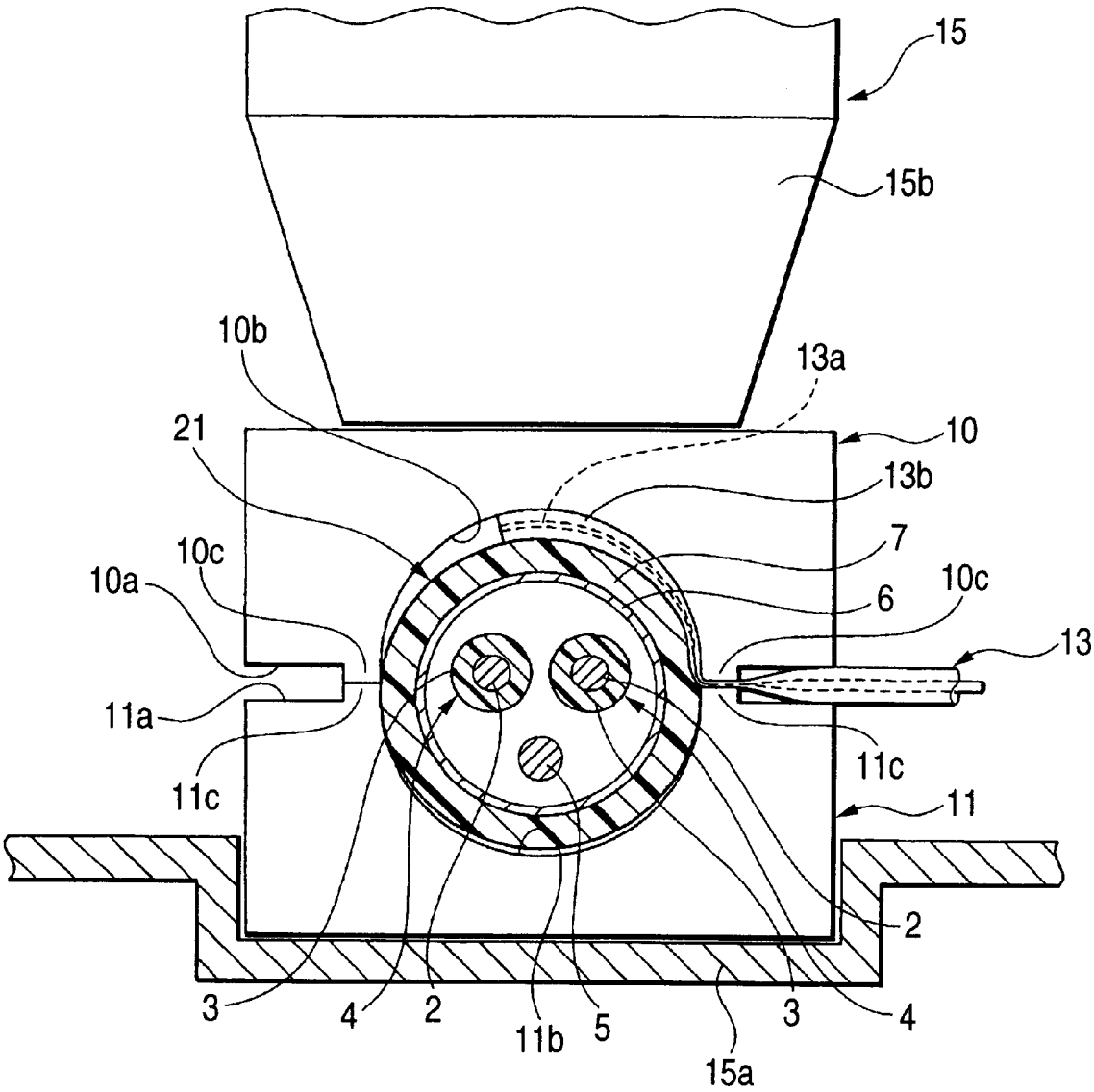
FIG. 10 is a view showing the set state of each member which is obtained immediately before the application of an ultrasonic vibration according to the third embodiment.
Figure 11:
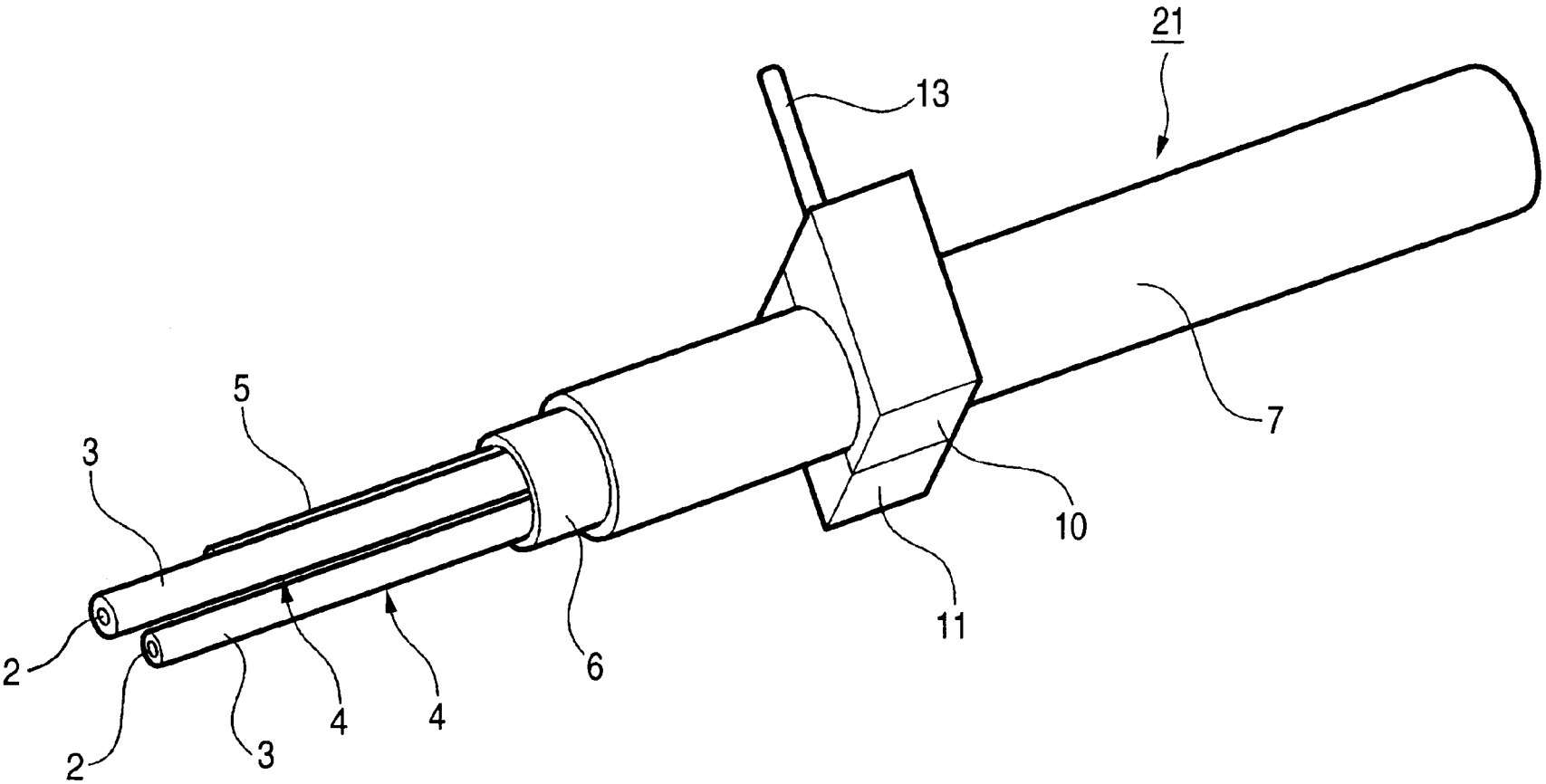
FIG. 11 is a perspective view showing a wire branching structure according to the third embodiment.

As shown in FIG. 10, the resin members 10 and 11 come in close contact with each other through the protrusions 10*c* and 11*c* before the ultrasonic vibration is given. When the ultrasonic vibration is started to be given in this state, the vibration energy concentrates on the protrusions 10*c* and 11*c*. Consequently, the resin members 10 and 11 are sufficiently fused in the vicinity of the mutual bonding faces 10*a* and 11*a* and firmly come in close contact with each other, and a vibration energy to be applied to the grounding wire 13 or the multicore shielded wire 1 can be reduced by the concentration of the vibration energy on the protrusions 10*c* and 11*c* of the resin members 10 and 11 and is transmitted such an extent that the insulating outer sheath 7 and the insulating outer sheath 13*b* can be fused so that the grounding wire 13 is connected electrically to the shielding cover 6. FIG. 11 shows a thus obtained wire branching structure of the multicore shielded wire.

Accordingly, the insulating inner sheath 3 of the multicore shielded wire 1 can be prevented from being broken or cut due to the fusion caused by the transmission of an excessive vibration energy. As described above, the resin members 10 and 11 can be connected firmly. In addition, it is possible to prevent a short circuit from being caused by the contact of the grounding wire 13 or the shielding cover 6 with the core 2, so that the strength of the multicore shielded wire 1 is prevented from being reduced.

Moreover, the protrusions 10*c* and 11*c* provided on the resin members 10 and 11 are disposed on the left and right of the concave portions 10*b* and 11*b* continuously along the peripheral edges thereof. Therefore, the vibration energy concentrates on the protrusions 10*c* and 11*c* in any position in the axial direction of the multicore shielded wire 1. Consequently, it is possible to uniformly reduce the vibration energy to be applied to the multicore shielded wire 1 in the axial direction of the multicore shielded wire 1.

Furthermore, the protrusions 10*c* and 11*c* are provided on both of the resin members 10 and 11 in the positions in which the bonding faces 10*a* and 11*a* are opposed to each other. Therefore, the resin members 10 and 11 can have the same shape. Consequently, there is an advantage that the manufacturing cost of the resin members 10 and 11 can be reduced and the resin members 10 and 11 can be handled easily.

While the protrusions 10*c* and 11*c* are provided on both of the bonding faces 10*a* and 11*a* of the resin members 10 and 11 in the embodiment, they may be provided on only at least one of the bonding faces 10*a* and 11*a* of the resin members 10 and 11.

Figure 12:
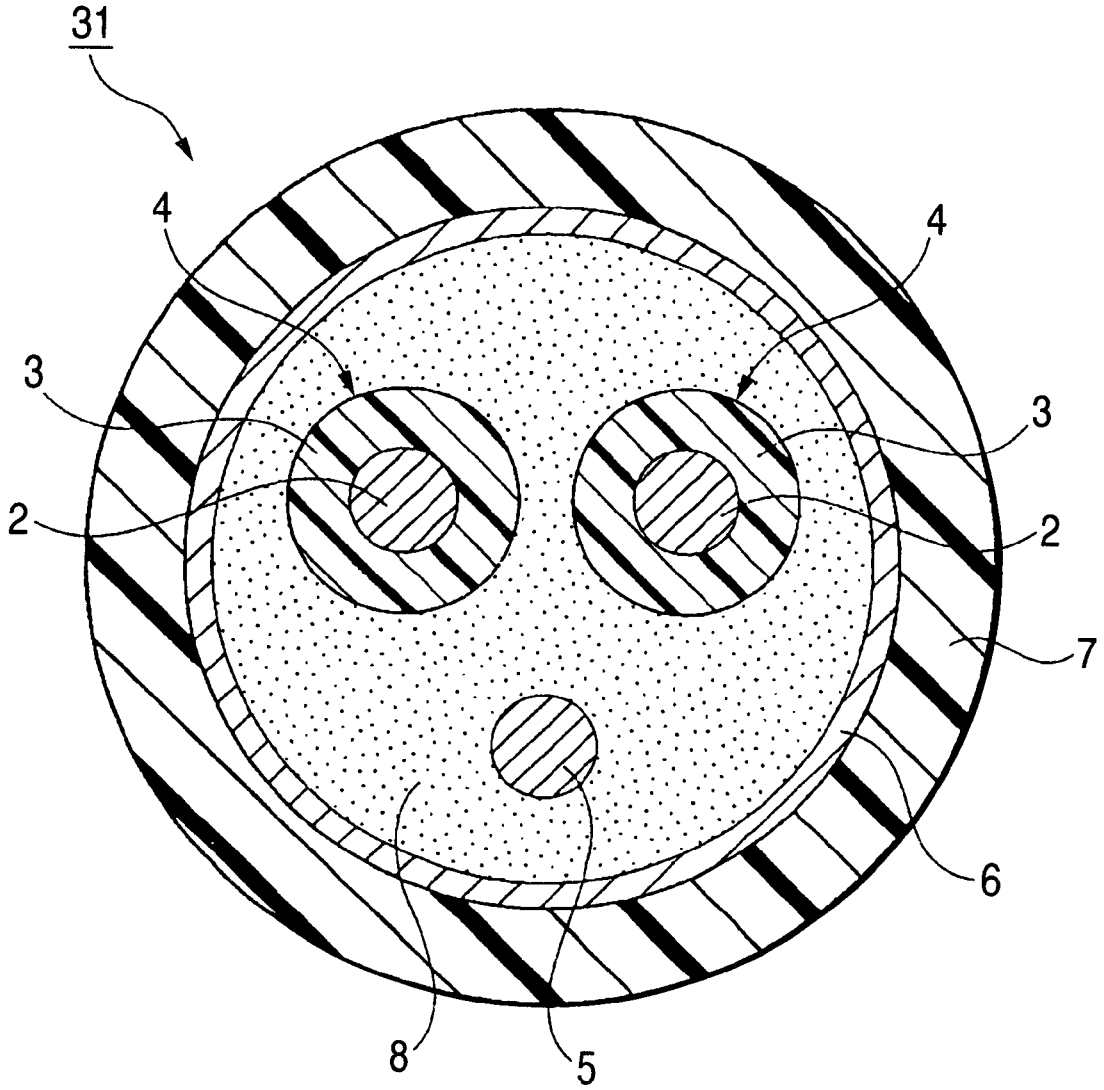
FIG. 12 is a sectional view showing a shielded wire according to a fourth embodiment of the invention.

FIG. 12 shows a multicore shielded wire according to a fourth embodiment of the invention. The multicore shielded wire 31 is constituted by two shielded core wires 4 each having a core wire 2 covered with an insulating inner casing 3, a drain wire 5, an aluminum foil to be a shielded cover 6 for covering the outer periphery of the two shielded core wires 4 and the drain wire 5, an insulating outer casing 7 for further covering the outer periphery of the shielding cover 6, and a heat-resistant insulating material 8 filled in the internal space of the shielding cover 6. The insulating inner casing 3 and the insulating outer casing 7 are formed of a synthetic resin. The core wire 2 and the drain wire 5 are formed of a conductive material. The insulating material 8 is formed of a resin having the same material as that of the insulating inner casing 3 or a heat-resistant resin such as polyethylene.

Figure 13:
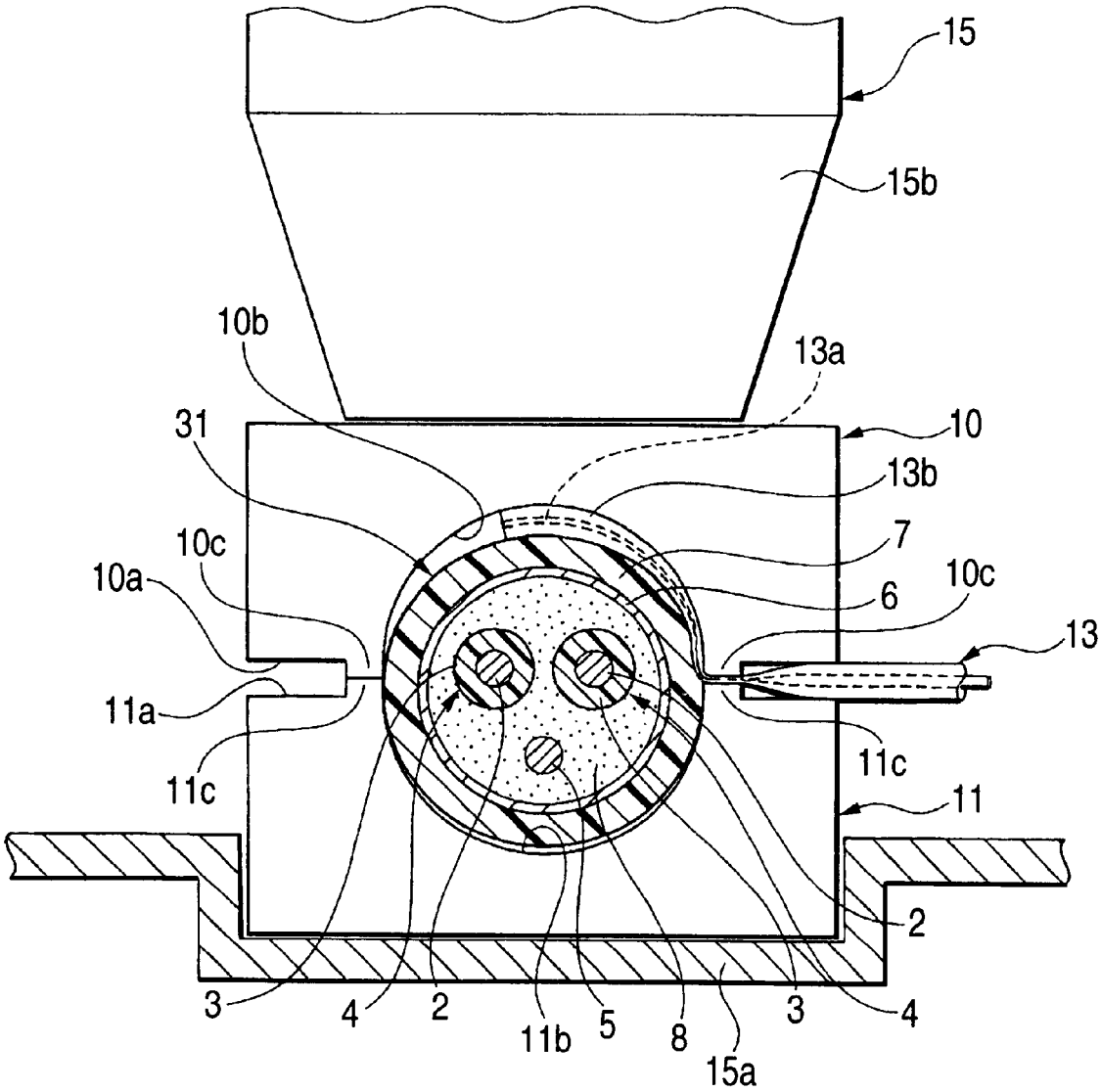
FIG. 13 is a view showing Fe set state of each member which is obtained immediately before the application of an ultrasonic vibration according to the fourth embodiment.

As shown In FIG. 13, the two shielded cores 4 are seldom moved because the insulating material 8 filled in the shielding cover 6. Therefore, it can be prevented the displacement of the core wires 4 and the shielding cover 6 can be occurred due to a pressurization between the resin members 10 and 11 and an ultrasonic vibration in ultrasonic welding. In addition, the outer periphery of the shielded core 4 is covered with the heat-resistant insulating material 8. Therefore, the insulating inner sheath 3 of the shielded core 4 is neither broken nor cut by heat generation caused by the ultrasonic vibration. Consequently, a short circuit between the grounding conductor 13 and the core 2 or between the cores 2 can be prevented reliably to enhance an insulating performance. Moreover, the electrical contact of the grounding conductor 13 and the shielding cover 6 can be obtained reliably by the fusion of their insulating outer sheaths 7 and 13*b* so that an electric performance can be enhanced.

The ultrasonic vibration generated by the ultrasonic horn 15 is transmitted to the shielded wire through the upper resin member 11. There is a problem that the aluminum foil 6*a* to be a part having a relatively small strength among the components of the shielded wire 100 is broken or cut by the vibration and heat generation so that the desired conduct state cannot be obtained. Moreover, when the aluminum foil 6*a* is broken or cut, the strength of the shielded wire is reduced accordingly.

Figure 14A:
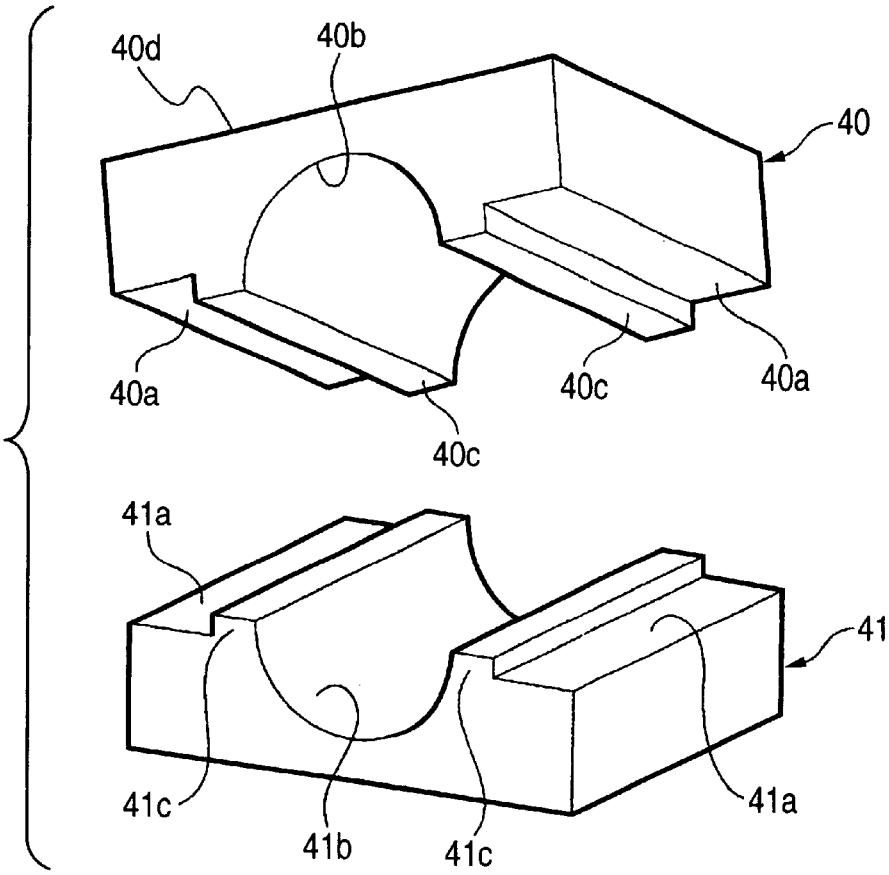
FIGS. 14A and 14B are perspective views showing a pair of resin members used in a shielded wire according to a fifth embodiment.
Figure 14B:
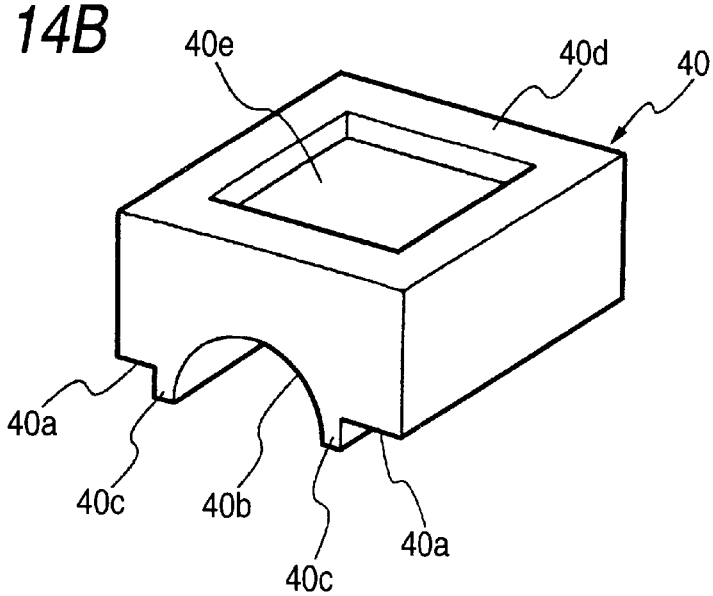

FIGS. 14A and 14B shows resin members according to a fifth embodiment of the invention provided to solve the above problem. As shown in FIG. 14A, the resin members 40 and 41 are blocks formed of a synthetic resin, and concave portions 40*b* and 41*b* for forming a hole almost corresponding to the outer sectional shape of the shielded wire 21 are formed with mutual bonding faces 40*a* and 41*a* butted against each other, respectively. The concave portions 40*b* and 41*b* are semicircular arc-shaped grooves having the radius of the outer shape of the shielded wire 21 set to be a radius in detail. Moreover, the resin members 40 and 41 are continuously provided with protrusions 40*c* and 41*c* on the left and right of the concave portions 40*b* and 41*b* along peripheral edges thereof. The protrusions 40*c* and 41*c* of the resin members 40 and 41 are provided in positions in which the bonding faces 40*a* and 41*a* are opposed to each other.

Moreover, as shown in FIG. 14B, the upper resin member 10 has a recessed portion 40*e* provided on a contact face 40*d* of the resin member 40 onto which the ultrasonic horn body 15*b* comes in contact. The recessed portion 40*e* is provided in a position opposing to a portion at which the shielding cover 6 and the grounding wire 13 come in electrical contact with each other.

Figure 15:
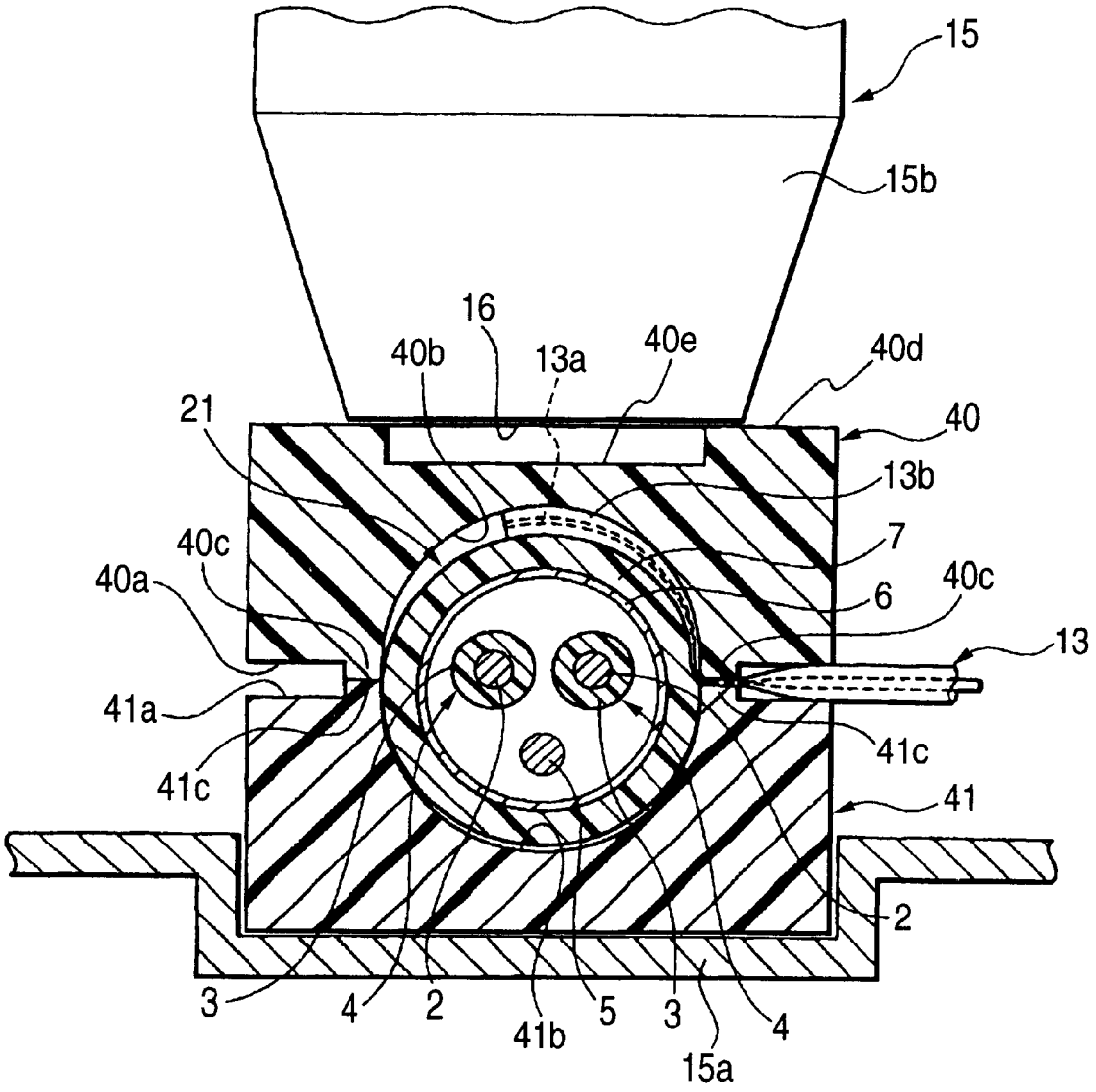
FIG. 15 is a view showing the set state of each member which is obtained immediately before the application of an ultrasonic vibration according to the fifth embodiment.
Figure 16:
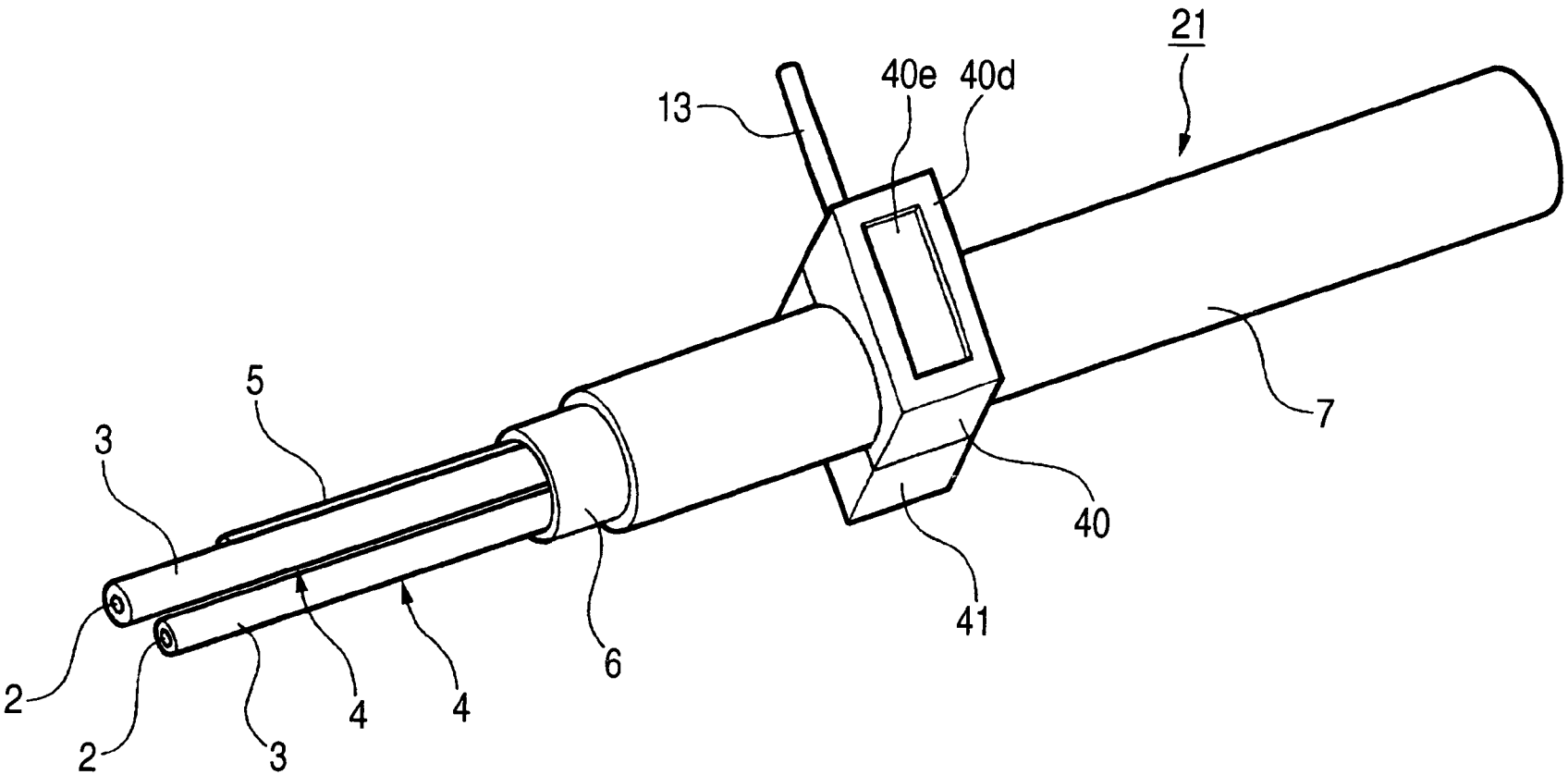
FIG. 16 is a perspective view showing a wire branching structure according to the fifth embodiment.
Figure 17:
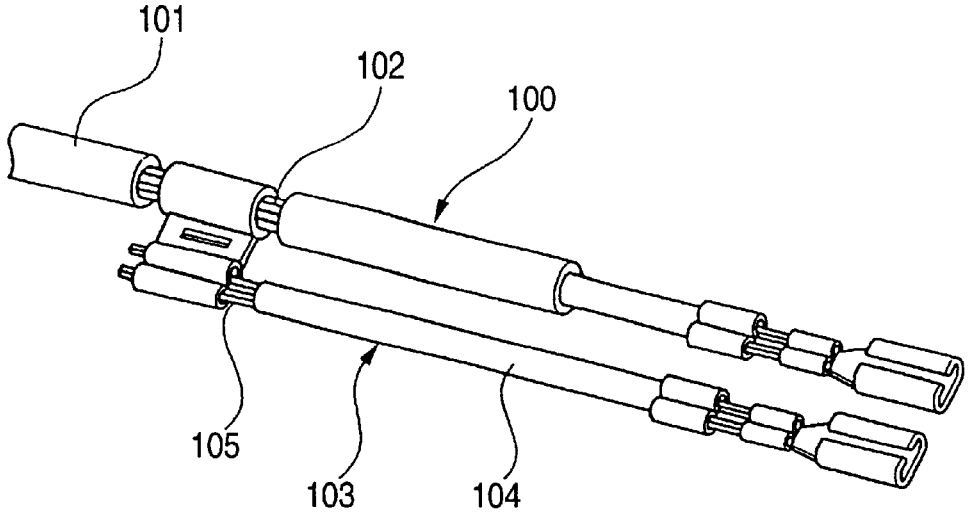
PRIOR ART FIG. 17
FIG. 17 Is a perspective view showing a wire branching structure according to a first related art.
Figure 18:
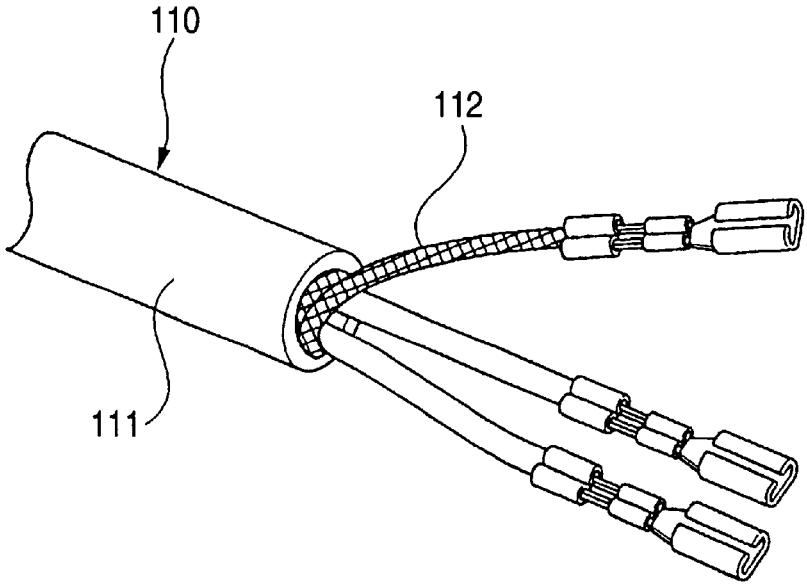
PRIOR ART FIG. 18
FIG. 18 is a perspective view showing a wire branching structure according to a second related art.
Figure 19:
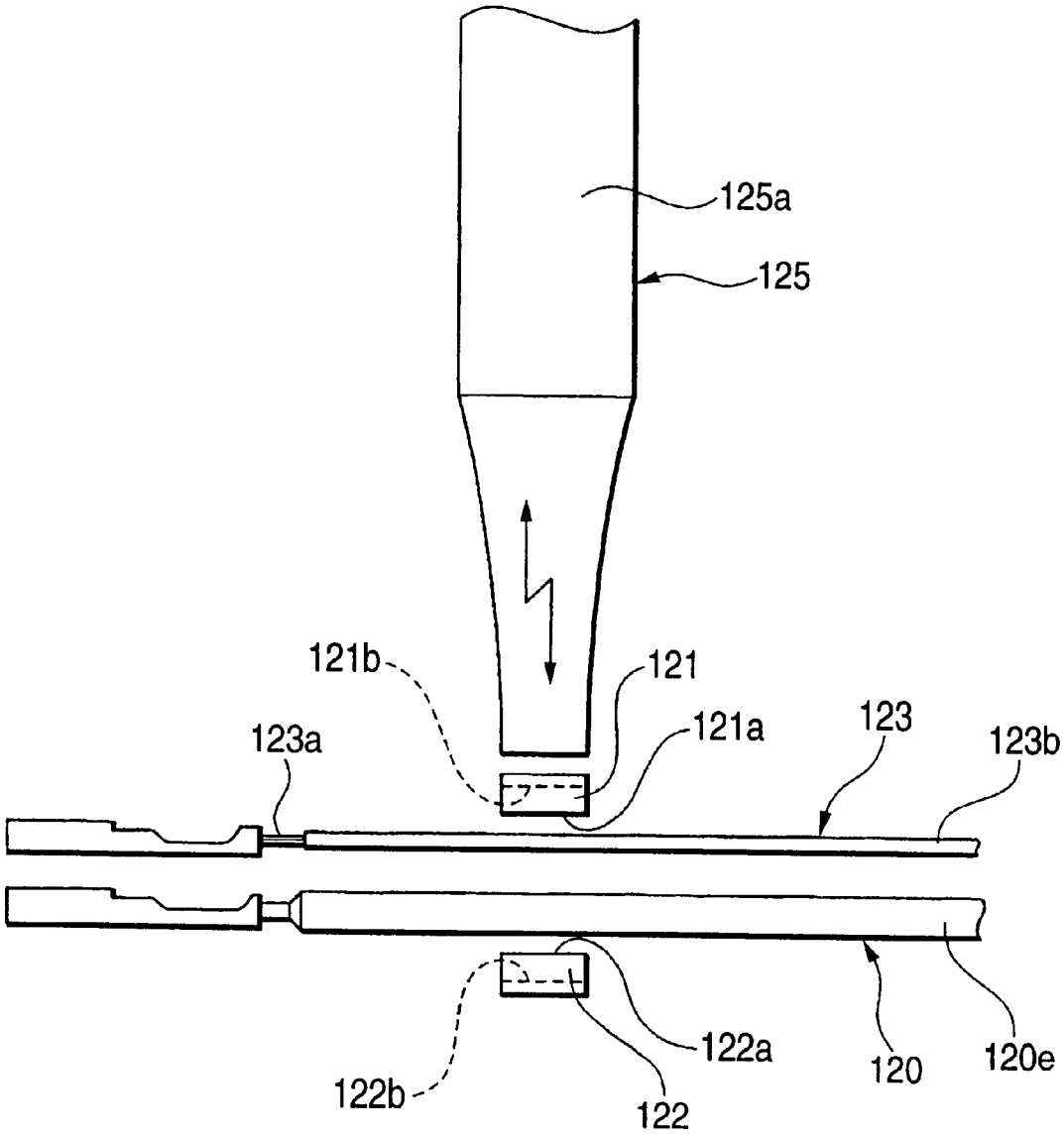
PRIOR ART FIG. 19
FIG. 19 is a front view showing a wire branching structure according to a third related art.
Figure 20:
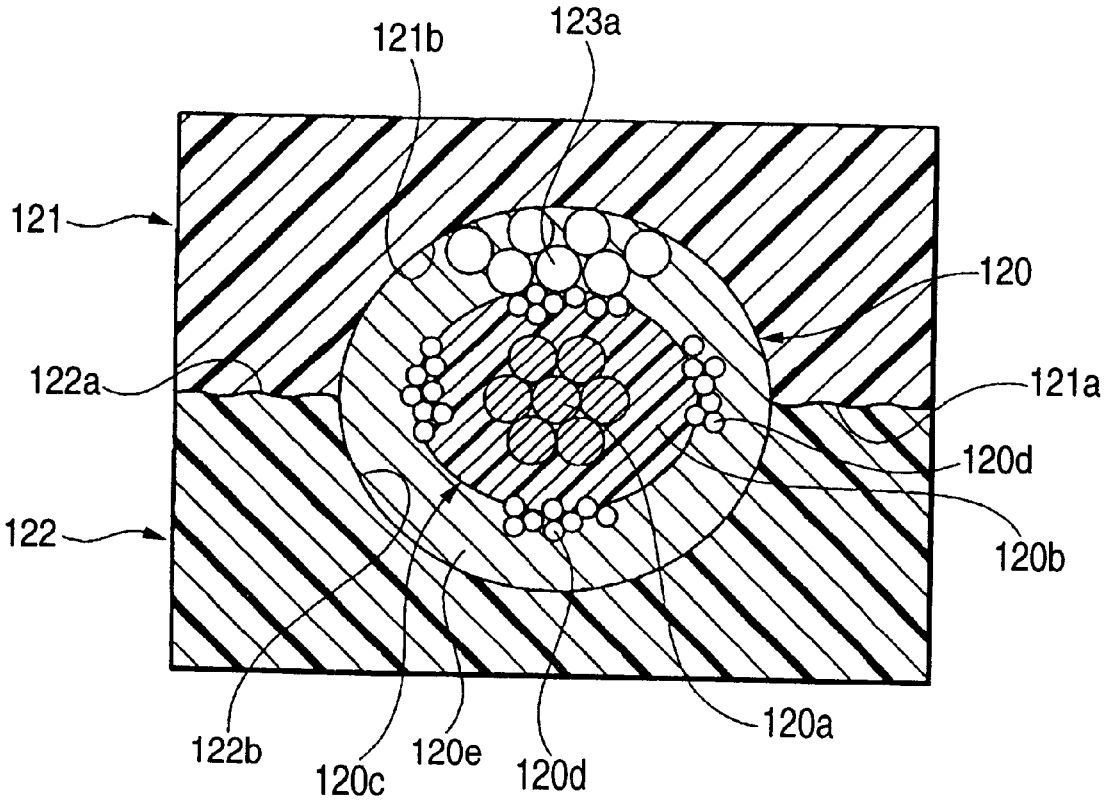
PRIOR ART FIG. 20
FIG. 20 is a sectional view showing the wire branching structure according to the third related art.

As shown in FIG. 15, the vibration generated from the ultrasonic horn body 15*b* is transmitted to the shielded wire 21 through the resin member 40 provided in contact therewith. The ultrasonic horn body 15*b* and the contact face 40*d* are provided in contact with each other in a small area through the recessed portion 40*e*. Therefore, the vibration to be applied to the shielding cover 6 of the shielded wire 21 through the resin member 40 can be reduced and the shielding cover 6 can be prevented from being broken or cut due to the ultrasonic vibration or heat generation. Accordingly, the electrical contact of the grounding wire 13 and the shielding cover 6 can be obtained reliably so that an electric performance can be enhanced. Furthermore, since the shielding cover 6 is neither broken nor cut due to the ultrasonic vibration and heat generation, it is possible to prevent such a situation that the strength of the electric wire is reduced. FIG. 16 shows a thus obtained wire branching structure of the multicore shielded wire.

Moreover, while the recessed portion 40*e* is provided on the contact face 40*d* of the resin member 40 side in the embodiment, it may be provided on a contact face 16 of the ultrasonic horn body 15*b*. Of course, the recessed portion 40*e* may be formed on both of the contact faces 40*d* and 16 in order to obtain the same functions and effects.

Furthermore, while the recessed portion 40*e* is provided in the position opposing to the portion at which the shielding cover 6 and the grounding wire 13 come in electric contact with each other, a vibration to be applied at the shortest distance from the ultrasonic horn body 15*b* to the electrical contact portion of the shielding cover 6 and the grounding wire 13 through the resin member 40 does not act.

Consequently, it is possible to effectively reduce the vibration to be applied to the electrical contact portion of the shielding cover 6 and the grounding wire 13.

In the above embodiments, when a plated wire having a relatively low melting temperature such as a tin plated electric wire is used as the conductive wire 13*a* of the grounding wire 13, the plated wire is partially fused by a vibration energy and better electric contact with the shielding cover 6 can be obtained. Therefore, a reliability in the contact portion of the shielding cover 6 and the conductive wire 13*a* of the grounding wire 13 can be enhanced. The relatively low melting temperature can be defined as a temperature which is lower than a temperature of the internal heat generated by the ultrasonic vibration.

While the insulating outer sheath 13*b* is not peeled when the grounding wire 13 is arranged between the resin member and the shielded wire in the above embodiments, the Insulating outer sheath 13*b* may be peeled. Furthermore, the contact connection of the shielding cover 6 and the conductive wire 13*a* is not restricted to thermal fusing based on an ultrasonic vibration.

While the aluminum foil 6*a* is used for the shielding cover 6 in the above embodiments, a conductive metal other than aluminum, particularly, a material having an excellent rolling property can also be used.

While the case in which the grounding wire 13 is to be earthed as the branch wire has been described, the branch wire to branch from the shielded wire is not restricted to the grounding wire 13 to be earthed but various embodiments can be employed without departing from the scope of the invention.

While the multicore shielded wire is provided with the drain wire 5 in the above embodiments, the drain wire 5 does not need to be always provided. If the drain wire 5 is provided, the shielding can also be carried out by earthing the drain wire 5. Therefore, there is an advantage that a variation in a countermeasure against the shielding can be increased correspondingly.

What is claimed is:

1. A shielded structure of a shielded wire, comprising:

at least one shielded core wire, in which a first conductive core wire is covered with a first insulating sheath;

a conductive foil, which covers the at least one shielded core wire;

a second insulating sheath, which covers the conductive foil;

a branch wire, in which a second conductive core wire is covered with a third insulating sheath; and a pair of resin members, in which a bonding face including a groove, is formed in each resin member and at least one protrusion is formed on at least one of the bonding faces, wherein the shielded core wire covered with the second insulating sheath and the branch wire are sandwiched between the pair of resin members such that the grooves face each other while accommodating the branch wire therein, wherein a part of the second insulating sheath and a part of the third insulating sheath are thermally fused so that the conductive foil and the second conductive core wire are electrically connected, and wherein the at least one protrusion includes two pairs of protrusions, each pair being formed at both sides of each groove, so as to be abutted on each other when sandwiched between the pair of resin members.

2. The shielded structure of a shielded wire as set forth in claim 1, further comprising a reinforcing member provided on an inner face of the conductive foil.

3. The shielded structure of a shielded wire as set forth in claim 2, wherein the reinforcing member is a polyester sheet.

4. The shielded structure of a shielded wire as set forth in claim 1, wherein a space between the conductive foil and the at least one shielded core wire is filled with an insulating material having a heat-resistant property.

5. The shielded wire according to claim 4, wherein the insulating material is polyethylene.

6. The shielded structure of a shielded wire as set forth in claim 1, further comprising a drain wire provided inside of the conductive foil.

7. The shielded wire according to claim 1, wherein the conductive foil is aluminum foil.

8. The shielded wire according to claim 7, wherein the aluminum foil has a thickness of 50 $\mu$m or more.

9. A shielded structure of a shielded wire, comprising:

at least one shielded core wire, in which a first conductive core wire is covered with a first insulating sheath;

a conductive cover member, which covers the at least one shielded core wire;

a second insulating sheath, which covers the conductive cover member;

a branch wire, in which a second conductive core wire is covered with a third insulating sheath, and a pair of resin members, in which a bonding face including a groove, is formed in each resin member and at least one protrusion is formed on at least one of the bonding faces, wherein the shielded core wire covered with the second insulating sheath and the branch wire are sandwiched between the pair of resin members such that the grooves face each other while accommodating the branch wire therein, wherein a part of the second insulating sheath and a part of the third insulating sheath are thermally fused so that the conductive cover member and the second conductive core wire are electrically connected; and wherein a space between the conductive cover member and the at least one shielded core wire is filled with an insulating material having a heat-resistant property, and wherein the at least one protrusion includes two pairs of protrusions, each pair being formed at both sides of each groove, so as to be abutted on each other when sandwiched between the pair of resin members.

10. The shielded structure of a shielded wire as set forth in claim 9, wherein the conductive cover member is a metal foil.

11. The shielded structure of a shielded wire as set forth in claim 10, further comprising a reinforcing member provided on an inner face of the conductive foil.

12. The shielded structure of a shielded wire as set forth in claim 11, wherein the reinforcing member is a polyester sheet.

13. The shielded structure of a shielded wire as set forth in claim 9, further comprising a drain wire provided inside of the conductive cover member.

14. A method of branching a sheathed wire from a shielded wire, comprising the steps of:

providing at least one shielded core wire, in which a first conductive core wire is covered with a first insulating sheath;

covering the at least one shielded core wire with a conductive cover member;

covering the conductive cover member with a second insulating sheath to constitute the shielded wire;

providing the sheathed wire in which a second conductive core wire is covered with a third insulating sheath;

providing a pair of resin members, in which a bonding face including a groove is formed in each resin member and at least one protrusion is formed on at least one of the bonding faces;

sandwiching the shielded wire and the sheathed wire between the pair of resin members such that the grooves face with each other while accommodating the sheathed wire therein; and applying ultrasonic vibration such that ultrasonic waves are concentrated to the protrusions to thermally fuse at least the protrusion so that the bonding faces of the resin members are integrated with each other, while thermally fusing a part of the second insulating sheath and a part of the third insulating sheath so that the conductive cover member and the second conductive core wire are electrically connected, wherein the at least one protrusion includes two pairs of protrusions, each pair being formed at both sides of each groove, so as to be abutted on each other in the sandwiching step.

15. The branching method as set claim 14, wherein the at least one protrusion includes a pair of protrusions, each pair being formed at both sides of at least one of the grooves, which are formed in each resin member, so as to extend therealong.

16. The branching method as set forth in claim 14, wherein the second conductive core wire is a plated wire having a melting temperature which is lower than a temperature of an internal heat generated by the ultrasonic vibration.

17. The branching method as set forth in claim 14, further comprising the steps of:

providing an ultrasonic horn for applying the ultrasonic vibration; and contacting a contact face of the ultrasonic horn with a contact face of one resin member, wherein at least one of the contact face of the ultrasonic horn and the contact face of the resin member is formed with a recessed portion.

18. The branching method as set forth in claim 17, wherein the recessed portion is situated at a position opposing to a position at which the conductive cover member and the second conductive core wire are electrically connected.

19. A method of branching a sheathed wire from a shielded wire, comprising the steps of:

providing at least one shielded core wire, in which a first conductive core wire is covered with a first insulating sheath;

covering the at least one shielded core wire with a conductive cover member;

covering the conductive cover member with a second insulating sheath to constitute the shielded wire;

providing the sheathed wire in which a second conductive core wire is covered with a third insulating sheath;

providing a pair of resin members, in which a bonding face including a groove is formed in each resin member, and in which a contact face is formed on one of the resin members;

sandwiching the shielded wire and the sheathed wire between the pair of resin members such that the grooves face with each other while accommodating the sheathed wire therein;

providing an ultrasonic horn having a contact face;

contacting the contact face of the ultrasonic horn with the contact face of the resin member; and applying ultrasonic vibration to thermally fuse and integrate the bonding faces of the resin members with each other, while thermally fusing a part of the second insulating sheath and a part of the third insulating sheath so that the conductive cover member and the second conductive core wire are electrically connected, wherein at least one of the contact face of the ultrasonic horn and the contact face of the resin member is formed with a recessed portion, wherein at least one protrusion is formed on at least one of the bonding faces, and wherein the at least one protrusion includes two pairs of protrusions, each pair being formed at both sides of each groove, so as to be abutted on each other in the sandwiching step.

20. The branching method as set forth in claim 19, wherein the recessed portion is situated at a position opposing to a position at which the conductive cover member and the second conductive core wire are electrically connected.

21. The branching method as set forth in claim 19, wherein the ultrasonic vibration is applied such that ultrasonic waves are concentrated to the protrusions to thermally fuse at least the protrusion while integrating the bonding faces of the resin members with each other.

22. The branching method as set forth in claim 21, wherein the at least one protrusion includes a pair of protrusions, each pair being formed at both sides of at least one of the grooves, which are formed in each resin member, so as to extend therealong.

23. The branching method as set forth in claim 19, wherein the second conductive core wire is a plated wire having a melting temperature which is lower than a temperature of an internal heat generated by the ultrasonic vibration.

* * * * *